US010460570B2

(12) United States Patent
Ikeda

(10) Patent No.: US 10,460,570 B2
(45) Date of Patent: Oct. 29, 2019

(54) AUTOMATIC TRANSACTION DEVICE

(71) Applicant: Oki Electric Industry Co., Ltd., Tokyo (JP)

(72) Inventor: Yasuyuki Ikeda, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/777,812

(22) PCT Filed: Nov. 25, 2016

(86) PCT No.: PCT/JP2016/085011
§ 371 (c)(1),
(2) Date: May 21, 2018

(87) PCT Pub. No.: WO2017/090742
PCT Pub. Date: Jun. 1, 2017

(65) Prior Publication Data

US 2018/0350199 A1 Dec. 6, 2018

(30) Foreign Application Priority Data

Nov. 28, 2015 (JP) ..... 2015-232538
Nov. 5, 2016 (JP) ..... 2016-216813

(51) Int. Cl.
*G07F 19/00* (2006.01)
*A47B 88/40* (2017.01)

(52) U.S. Cl.
CPC ..... *G07F 19/205* (2013.01); *A47B 88/40* (2017.01)

(58) Field of Classification Search
CPC . G07F 19/205; A47B 88/40; A47B 2097/008; A47B 91/08
USPC ..... 312/330.1, 351–351.14, 352
See application file for complete search history.

(56) References Cited

U.S. PATENT DOCUMENTS 2,725,667 A * 12/1955 Ingarra ..... A47B 91/024 16/19
3,054,583 A * 9/1962 Deye ..... B64F 1/16 114/294
4,199,072 A * 4/1980 Jacks ..... H02B 1/40 220/3.4
4,202,083 A * 5/1980 Gutner ..... A47B 91/024 248/300
4,497,261 A * 2/1985 Ferris ..... G07F 19/205 109/2

(Continued)

FOREIGN PATENT DOCUMENTS

JP H08-123990 A 5/1996
JP 2002-032818 A 1/2002

*Primary Examiner* — Daniel J Troy
*Assistant Examiner* — Timothy M Ayres
(74) *Attorney, Agent, or Firm* — Rabin & Berdo, P.C.

(57) ABSTRACT

The present disclosure provides an automatic transaction device including: a device casing that is formed at side faces of the device; a door that can be opened and closed to form a device opening at one face of the device; and a device base plate that is formed at a base of the device, a first gap is present between an internal unit of the device and the device casing, the device base plate includes plural fixing member holes disposed in the first gap for fixing the device to a floor, and the fixing member holes are disposed at the device opening side with respect to a backmost position as viewed from the device opening.

11 Claims, 24 Drawing Sheets

(56) References Cited

U.S. PATENT DOCUMENTS

| | | | | | |
|---|---|---|---|---|---|
| 4,561,704 | A * | 12/1985 | Smith | G07F 19/20 | 312/210 |
| 5,036,779 | A * | 8/1991 | Capraro | A47F 10/00 | 109/2 |
| 5,176,437 | A * | 1/1993 | Remington | A47B 91/08 | 248/500 |
| 6,457,277 | B1 * | 10/2002 | Meyers | G07F 19/20 | 109/24.1 |
| 6,595,606 | B1 * | 7/2003 | Gunst | G07F 19/20 | 109/24.1 |
| 7,775,498 | B2 * | 8/2010 | Phillips | A47L 15/4253 | 248/500 |
| 8,020,416 | B2 * | 9/2011 | Talmage | E05G 1/00 | 109/45 |
| 8,659,905 | B2 * | 2/2014 | Knoop | H05K 5/02 | 312/223.2 |
| 8,844,807 | B1 * | 9/2014 | Lawver | G07F 19/205 | 235/375 |
| 9,405,264 | B2 * | 8/2016 | Ishiwata | A47B 91/08 | |
| 2008/0116330 | A1 * | 5/2008 | Cotto | A47B 91/024 | 248/188.4 |
| 2009/0184614 | A1 * | 7/2009 | Walsberg | A47B 91/024 | 312/351.3 |
| 2011/0315708 | A1 * | 12/2011 | Shih | G07D 11/0006 | 221/279 |

* cited by examiner

RELATED ART

RELATED ART

AUTOMATIC TRANSACTION DEVICE

TECHNICAL FIELD

The present disclosure relates to an automatic transaction device installed in a bank, convenience store, or consumer finance outlet.

BACKGROUND ART

In recent times, automatic transaction devices such as automatic teller machines are installed in various locations including banks, convenience stores, and consumer finance outlets. In comparatively secure locations such as bank lobbies, such automatic transaction devices are often installed directly to the floor as stand-alone casings. However, automatic transaction devices installed in convenience stores or consumer finance outlets are fixed to the ground using anti-theft anchor bolts (see, for example, Japanese Patent Application Laid-Open (JP-A) No. 2002-32818). Moreover, recently such devices are generally fixed using approximately four anchor bolts in order to enhance load withstanding strength and to improve security.

FIG. 23 is a perspective view illustrating a configuration of a conventional automatic transaction device. FIG. 24 is an explanatory diagram illustrating the interior of a conventional automatic transaction device, as viewed from above.

As illustrated in FIG. 23 and FIG. 24, a safe unit 5 and device internal components 10, such as a control board 10*a* controlling the safe unit 5, a wiring member 10*b*, and a connector 10*c*, are disposed in the device interior of an automatic transaction device 101.

The safe unit 5 is pulled out in the arrow A direction using slide rails 11 for maintenance or the like. Two anchor bolt holes 109*a* and 109*b* are disposed at the device front side of a device base plate 3, and two anchor bolt holes 109*c* and 109*d* are disposed at backmost positions on the device base plate 3.

When fixing the automatic transaction device 101 to the ground during installation, anchor bolts that have been pre-embedded in concrete or the like in the ground are passed through the anchor bolt holes 109*a*, 109*b*, 109*c*, and 109*d* and fixed using nuts or the like.

SUMMARY OF INVENTION

Technical Problem

In the automatic transaction device 101 configured as described above, the positions of the two anchor bolt holes 109*a*, 109*b* at the device front side are accessible by hand by unlocking a door lock 2*a* and opening a safe door 2 in the arrow B direction, thereby enabling a device fixing operation using the anchor bolts to be performed.

However, in slim-type automatic transaction devices for installation in a convenience store or the like, often a depth direction length Lz of the machine is around one meter or greater, and a device opening 2*b* when the safe door 2 has been opened is often narrow, with a width of around 300 mm and a height of around 500 mm. Moreover, the safe unit 5 and the device internal components 10, such as the control board 10*a*, the wiring member 10*b* and the connector 10*c*, are present inside the device. The two anchor bolt holes 109*c*, 109*d* at the backmost positions are thus inaccessible by hand, presenting difficulty when performing an operation to fix the device using anchor bolts.

There has therefore been a need for a worker to pull out the safe unit 5 in the arrow A direction, and then to temporarily disconnect the connector 10*c* and completely remove the safe unit 5 and the like, before then putting his body inside the device to perform the operation to fix the device using anchor bolts. After performing the operation to fix the device using anchor bolts, the worker then needs to remount the safe unit 5 and the device internal components 10, such as the control board 10*a*, the wiring member 10*b* and the connector 10*c*.

Thus, the installation of a conventional automatic transaction device 101 has been a time-consuming and complex operation, and there was also the risk that mistakes in the operation to remount the device internal components 10, such as the control board 10*a*, the wiring member 10*b* and the connector 10*c*, might result in initial defaults.

The present disclosure provides an automatic transaction device that enables an operation to fix the device using anchor bolts to be carried out in a state close to the state when the device leaves the factory, without removing the safe unit 5 or the device internal components 10, such as the control board 10*a*, the wiring member 10*b* and the connector 10*c*.

Solution to Problem

A first aspect of the present disclosure is an automatic transaction device including: a device casing that is formed at side faces of the device; a door that can be opened and closed to form a device opening at one face of the device; and a device base plate that is formed at a base of the device, wherein, a first gap is present between an internal unit of the device and the device casing, wherein the device base plate includes a plurality of fixing member holes disposed in the first gap, for fixing the device to a floor, and wherein the fixing member holes are disposed at a side of the device opening with respect to a backmost position, as viewed from the device opening.

A second aspect of the present disclosure, in the above first aspect, the fixing member holes may be disposed at a vicinity of the device opening in the first gap, which is present at a left and a right of the internal unit, as viewed from the device opening.

A third aspect of the present disclosure, in the above second aspect, may further include a moving means that enables the internal unit to be moved outside the device through the device opening, the moving means may form a second gap for work-access to fix a fixing member to the device base plate by forming the second gap between the device opening and a rear edge of the internal unit, after the internal unit has been moved outside the device.

A fourth aspect of the present disclosure, in the above third aspect, the fixing member holes may also be separated from a device internal component installed in the first gap, by more than a rotation radius of an attachment tool for an attachment operation in the device opening side.

A fifth aspect of the present disclosure, in the above fourth aspect, the fixing member holes may also be disposed to prevent interference between the attachment tool and a device internal component, in a case in which the attachment tool would be rotated by a predetermined angle.

A sixth aspect of the present disclosure, in the above first aspect, may further include a moving means that enables the internal unit to be moved outside the device through the device opening, the fixing member holes may be respectively disposed in the first gap, which is present at a left and a right of the internal unit, as viewed from the device opening, so as to be disposed in a vicinity of the device opening and at an approximate center in a device depth direction.

A seventh aspect of the present disclosure, in the above sixth aspect, the moving means may form a second gap for work-access to fix a fixing member to the device base plate by forming the second gap between the device opening and a rear edge of the internal unit after the internal unit has been moved outside the device.

An eighth seventh aspect of the present disclosure, in the above seventh aspect, the fixing member hole disposed at the approximate center in the device depth direction may be disposed to prevent interference between an attachment tool and a device internal component, in a case in which the attachment tool would be rotated by a predetermined angle.

A ninth aspect of the present disclosure, in the above eighth aspect, the fixing member hole disposed at the approximate center in the device depth direction may be disposed at a device depth within an arm's length range of an average adult.

A tenth aspect of the present disclosure, in the third aspect or the seventh aspect, the device may be fixed to the floor by access through the second gap, to fix the fixing members to the device base plate at the fixing member holes.

An eleventh aspect of the present disclosure, in the above first aspect, may further include: a moving means that enables the internal unit to be moved outside the device through the device opening; and a device internal component that is part of the internal unit and is disposed at one side of the first gap present on the left and the right of the internal unit as viewed from the device opening, wherein the fixing member holes may be respectively disposed in the first gap present on the left and the right of the internal unit as viewed from the device opening, so as to be disposed in the vicinity of the device opening and at an approximate center in a device depth direction on another side of the first gap present on the left and right of the internal unit.

A twelfth aspect of the present disclosure, in the above eleventh aspect, the moving means may form a second gap for work-access to fix a fixing member to the device base plate by forming the second gap between the device opening and a rear edge of the internal unit after the internal unit has been moved outside the device.

A thirteenth aspect of the present disclosure, in the above twelfth aspect, the device may be fixed to the floor by access through the second gap so as to utilize the fixing member hole disposed at the approximate center in the device depth direction to fix the fixing member to the device base plate.

A fourteenth aspect of the present disclosure, in the above aspects, the fixing member holes may be a plurality of holes disposed in advance to match different placement configurations.

Advantageous Effects of the Invention

The above aspects of the present disclosure enable a device to be fixed by fixing member holes in a first gap between a device casing and an internal unit, the fixing member holes being disposed at a side of a device opening with respect to a backmost position as viewed from the device opening, and in particular, by fixing member holes disposed in the vicinity of the device opening. Thus, the above aspects of the present disclosure may enable a device fixing operation using fixing members to be performed in a state close to the state when the device leaves the factory, without removing the internal unit or device internal components 10, such as the control board 10*a*, the wiring member 10*b* and the connector 10*c*. As a result, the above aspects of the present disclosure may facilitate a device fixing operation using the fixing members, and also may enable the prevention of initial problems arising from remounting the internal unit and the device internal components.

DESCRIPTION OF EMBODIMENTS

First Exemplary Embodiment

Figure 1:
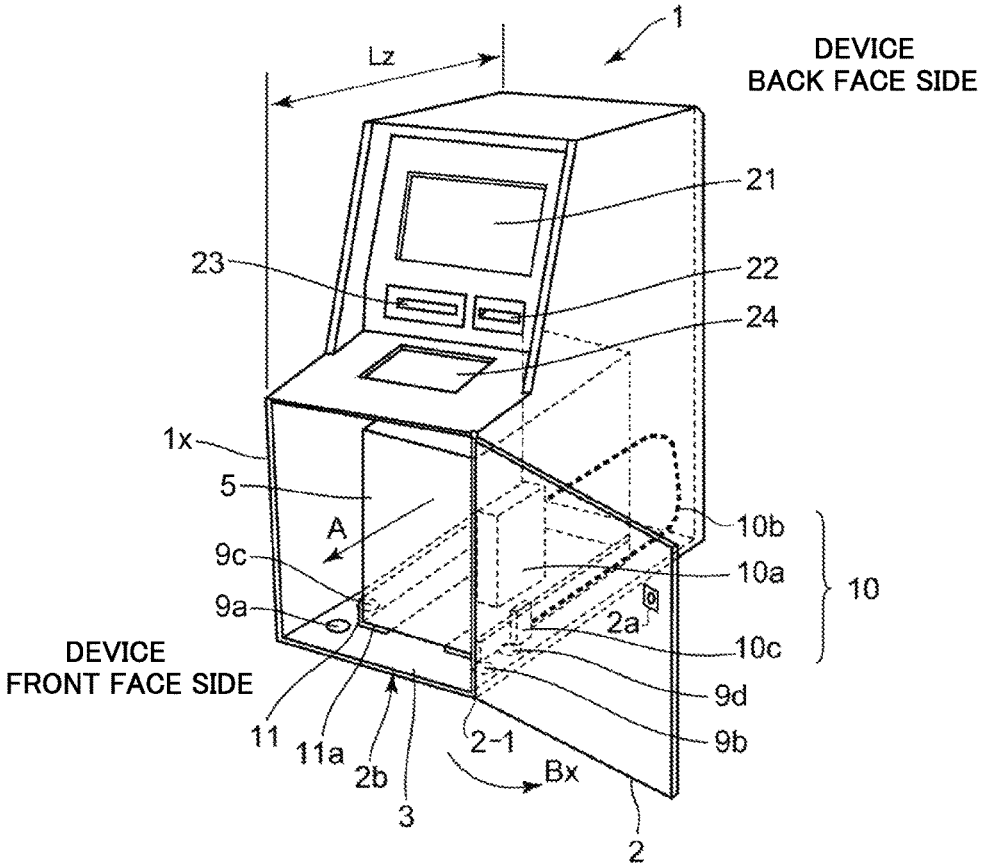
FIG. 1 is a perspective view illustrating a configuration of an automatic transaction device according to a first exemplary embodiment.

Explanation follows regarding a first exemplary embodiment for implementing the present disclosure. Common elements are allocated the same reference numerals in each of the drawings. Explanation follows regarding configuration of an automatic transaction device according to the first exemplary embodiment. Note that the following explanation describes an example in which an automatic transaction device includes a safe door 2 at a device front side, enabling maintenance to be performed from the device front side by opening the safe door 2. However, the automatic transaction device may be configured with the safe door 2 provided at a back face or a side face, such that maintenance is performed from the back face or the side face.

FIG. 1 is a perspective view illustrating a configuration of an automatic transaction device according to the first exemplary embodiment. The automatic transaction device 1 is covered by a device casing 1*x*. The safe door 2, a customer operation section 21, a card insertion/return port 22, a passbook insertion/return port 23, and a cash pay-in/pay-out port 24 are all provided at a front face side of the device.

The device casing 1*x* is configured from steel plates, and forms side faces, a back face, and an upper face of the automatic transaction device 1. A device base plate 3 configuring a bottom face will be described later. The front face of the automatic transaction device 1 is provided with the safe door 2 serving as a door that can be opened and closed to form a device opening 2*b*. The safe door 2 includes a door lock 2*a* on the left side when viewing the automatic transaction device 1 from the front. The door lock 2*a* is locked or unlocked to open and close the safe door 2 in the arrow Bx direction about a door hinge 2-1 on the right side when viewing the automatic transaction device 1 from the front. The safe door 2 is opened to form the device opening 2*b* during installation and during maintenance of the automatic transaction device 1. Installation operations or maintenance operations on the automatic transaction device 1 are performed through the device opening 2*b* formed when the safe door 2 is open. From the perspective of crime prevention, the safe door 2 is preferably a reinforced door.

The customer operation section 21 displays operation guidance screens for performing automated transactions such as paying in or paying out cash. A customer performs selection operations and input operations according to each desired transaction. The cash pay-in/pay-out port 24 is a pay-in/pay-out port into which cash such as banknotes and coins is inserted in a pay-in transaction, and from which cash such as banknotes and coins is removed in a pay-out transaction. The card insertion/return port 22 is an insertion/return port through which a card such as a cash card is inserted and returned. The passbook insertion/return port 23 is an insertion/return port through which a passbook is inserted and returned in a passbook transaction.

The automatic transaction device 1 according to the first exemplary embodiment is configured capable of performing pay-in/pay-out transactions and passbook transactions using these sections according to customer operation. For example, in a pay-in transaction, cash paid in through the cash pay-in/pay-out port 24 is stored in the safe unit 5, described later. In a pay-out transaction, cash is fed out from the safe unit 5 and paid out through the cash pay-in/pay-out port 24.

The device base plate 3, the safe unit 5 serving as an internal unit, a control board 10*a*, a wiring member 10*b*, and a connector 10*c* are disposed at the device inside of the automatic transaction device 1. The control board 10*a* is a device internal component 10 that is part of the safe unit 5 and that controls the safe unit 5. First gaps L1, described later, are formed between the safe unit 5 and the device casing 1*x*.

The device base plate 3 is formed at a base portion of the automatic transaction device 1, and retains the safe unit 5 of the automatic transaction device 1. The device base plate 3 is configured from a thick steel plate, and is fixed to the side faces and the back face of the device casing 1*x* of the automatic transaction device 1 by welding or the like. The device base plate 3 is used to mount the safe unit 5 and the device internal components 10. The device base plate 3 is provided with plural anchor bolt holes 9*a*, 9*b*, 9*c*, and 9*d*. The automatic transaction device 1 is then fixed to the ground 6 by anchor bolts 7, serving as fixing members illustrated in FIG. 2.

The anchor bolt holes 9*a*, 9*b*, 9*c*, and 9*d* according to the first exemplary embodiment are disposed such that two holes are present on each of the left and right sides of the device base plate 3, in the vicinity of the device opening 2*b* in the first gaps L1 formed at the left and right between the device casing 1*x* and the safe unit 5. Namely, when viewed through the device opening 2*b*, the anchor bolt holes 9*a* and 9*c* are disposed in the first gap L1 on the device left side, and the anchor bolt holes 9*b* and 9*d* are disposed in the first gap L1 on the device right side.

When installing the automatic transaction device 1 on the ground 6, anchor bolts 7 provided in advance in the ground 6 are passed through the anchor bolt holes 9*a*, 9*b*, 9*c*, and 9*d*, and the automatic transaction device 1 is fixed to the ground 6 using nuts or the like. Hereafter, the anchor bolt holes 9*a*, 9*b*, 9*c*, and 9*d* are referred to collectively as the anchor bolt holes 9.

The safe unit 5 stores cash that has been paid in in pay-in transactions, and also feeds out cash in pay-out transactions. Slide rails 11 are provided on the lower side face at the left and right of the safe unit 5 as viewed from the device opening 2*b*. The slide rails 11 configure a moving means to enable the safe unit 5 to be moved outside the device through the device opening 2*b*. A fixed portion 11*a* of each of the slide rails 11 is fixed to the device base plate 3. During installation or maintenance of the automatic transaction device 1, the safe unit 5 can be pulled outside the device by sliding in the arrow A direction using the slide rails 11.

Note that an example is given in which the slide rails 11 are fixed to the device base plate 3. However, the present exemplary embodiment is not limited to this example, and, for example, the slide rails 11 may be fixed to side faces inside the device casing 1*x*.

In the first gaps L1 formed on the left and right between the safe unit 5 and the device casing 1*x*, the control board 10*a* is fixed to a right side face of the safe unit 5, as viewed from the device opening 2*b*. The control board 10*a* is provided on the right side face of the safe unit 5, slightly toward the device opening 2*b* from the approximate center in a device depth direction. The control board 10*a* is, for example, configured by a control board that mechanically controls the safe unit 5, and is connected to the wiring member 10*b*, described later. The control board 10*a* controls the storage of cash paid in in pay-in transactions, and controls the feed-out of cash in pay-out transactions. The wiring member 10*b* is a connecting cord that connects the connector 10*c* of the automatic transaction device 1 to the control board 10*a*. In the first gaps L1 formed at the left and right between the safe unit 5 and the device casing 1*x*, the connector 10*c* is fixed to the device base plate 3 in the first gap L1 at the right side face as viewed from the device opening 2*b*. The connector 10*c* is also connected to the wiring member 10*b*.

The control board 10*a* and the wiring member 10*b* are pulled outside the device when the safe unit 5 is pulled outside the device using the slide rails 11. The connector 10*c*, on the other hand, remains fixed inside the device.

Figure 2:
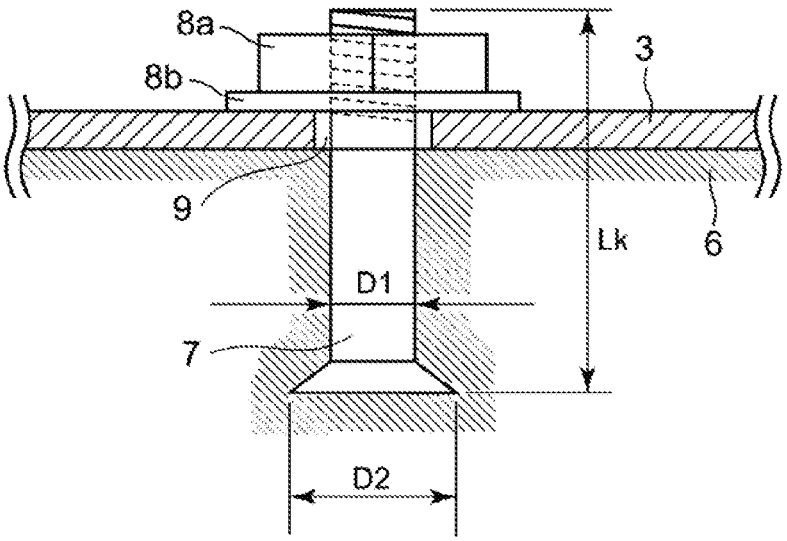
FIG. 2 is a side view illustrating a configuration of an anchor bolt for fixing an automatic transaction device according to the first exemplary embodiment.

Next, explanation follows regarding configuration of the anchor bolts 7 configuring fixing members that fix the automatic transaction device 1 to a floor. FIG. 2 is a side view illustrating a configuration of an anchor bolt for fixing the automatic transaction device according to the first exemplary embodiment. The anchor bolts 7 are provided so as to match the positions of the anchor bolt holes 9*a*, 9*b*, 9*c*, and 9*d* in the device base plate 3, and are embedded in the ground 6 as illustrated in FIG. 2 at a step prior to installation of the automatic transaction device 1.

Namely, holes for embedding the anchor bolts 7 are first formed in the ground 6 where the automatic transaction device 1 is to be installed, so as to match the positions of the anchor bolt holes 9*a*, 9*b*, 9*c*, and 9*d* in the device base plate 3. The anchor bolts 7 are inserted through the formed holes and fixed by concrete or the like.

When installing the automatic transaction device 1, as illustrated in FIG. 2, the anchor bolts 7 are passed through the anchor bolt holes 9*a*, 9*b*, 9*c*, and 9*d* in the device base plate 3, and each anchor bolt 7 is fixed using a nut 8*a* and washer 8*b*. The automatic transaction device 1 is thereby fixed to the ground 6.

Note that diameters D1, D2 on each anchor bolt 7, and a length Lk of each anchor bolt 7, are set so as to withstand load such that the anchor bolts 7 do not deform to let the automatic transaction device 1 tilt, nor do the anchor bolts 7 snap, when the automatic transaction device 1 is applied with force from the front, rear, left, or right directions.

Figure 3:
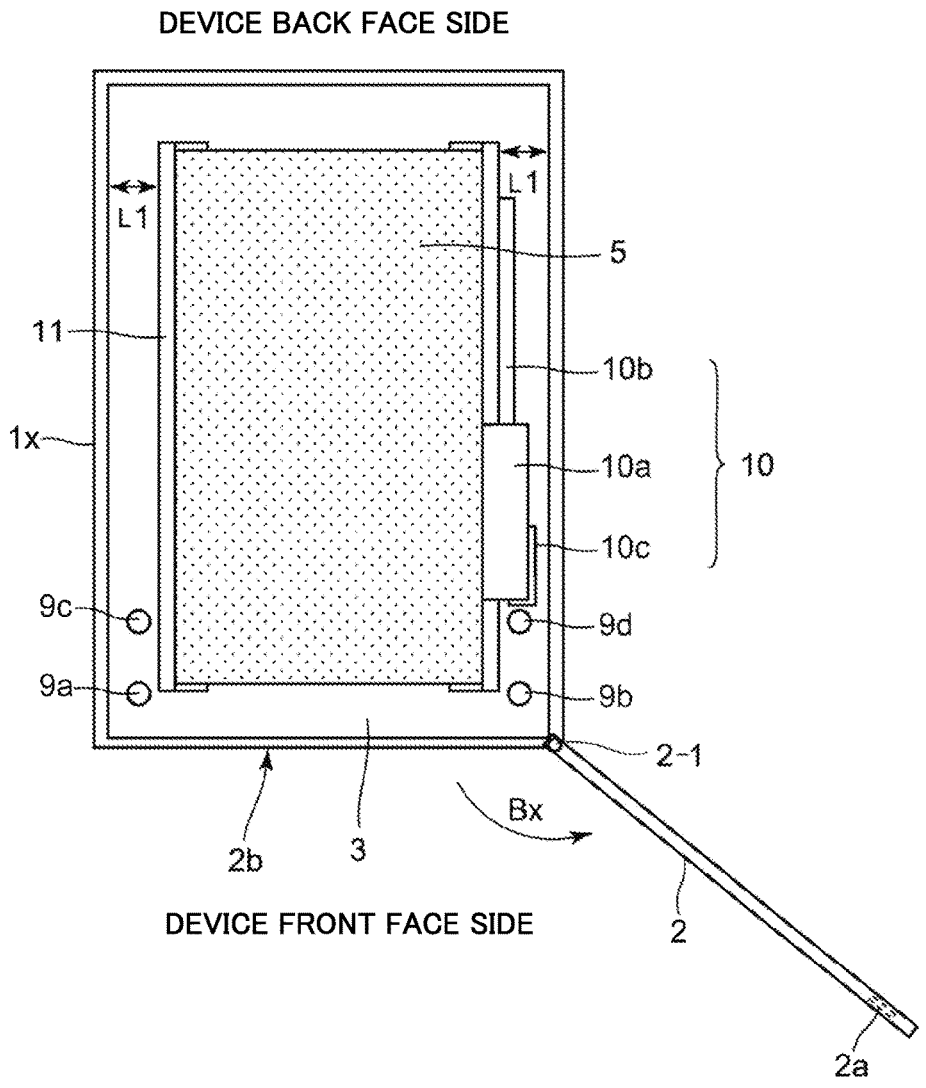
FIG. 3 is an explanatory diagram illustrating the interior of an automatic transaction device according to the first exemplary embodiment, as viewed from above.

Next, explanation follows regarding a placement configuration of the anchor bolt holes of the automatic transaction device 1, with reference to FIG. 3. FIG. 3 is an explanatory diagram of the interior of the automatic transaction device according to the first exemplary embodiment, as viewed from above. Note that FIG. 3 illustrates a state in which the safe door 2 has been opened in the arrow Bx direction. The device internal components 10, such as the control board 10*a* and the wiring member 10*b*, are disposed in the first gap L1 on the right side of the safe unit 5 as viewed from the device opening 2*b*, and such components are not disposed in the first gap L1 on the left side of the safe unit 5. The anchor bolt holes 9 configuring fixing member holes are not disposed in the device base plate 3 of the automatic transaction device 1 at backmost positions as viewed from the device opening 2*b*. The anchor bolt holes 9 are disposed at the front side, namely toward the device opening 2*b*, of the backmost positions.

Namely, plural of the anchor bolt holes 9 are disposed in the vicinity of the device opening 2*b* in each of the first gaps L1 on the left and right of the safe unit 5 as viewed from the device opening 2*b*, i.e. there are two of the anchor bolt holes 9 on both the left and right. Specifically, in the first gap L1 on the device left side, the anchor bolt holes 9*a* and 9*c* are disposed to the front and rear, such that the anchor bolt hole 9*a* is disposed in close proximity to the device opening 2*b*, and the anchor bolt hole 9*c* is disposed slightly further from the device opening 2*b*. On the other hand, in the first gap L1 on the device right side, the anchor bolt holes 9*b* and 9*d* are disposed to the front and rear of each other, such that the anchor bolt hole 9*b* is disposed in close proximity to the device opening 2*b*, and the anchor bolt hole 9*d* is disposed slightly further from the device opening 2*b*.

The first gaps L1 are gaps formed between the safe unit 5 and the device casing 1*x*, and are gaps where the anchor bolt holes 9 are formed as fixing member holes in the device base plate 3.

Note that in order to facilitate a device fixing operation using the anchor bolts 7, the anchor bolt holes 9*b* and 9*d* on the device right side are preferably disposed at positions that do not interfere with the device internal components 10, such as the control board 10*a* and the wiring member 10*b*.

With the configuration described above, the device fixing operation to fix the automatic transaction device 1 according to the first exemplary embodiment using the anchor bolts 7 is performed in the following manner. First, a worker performs an anchor bolt fixing operation to fix the anchor bolts 7 in the ground 6. In this anchor bolt fixing operation, the holes in which to embed the anchor bolts 7 are first formed in the ground 6 where the automatic transaction device 1 is to be installed. The positions for forming the holes match the four positions corresponding to the anchor bolt holes 9*a*, 9*b*, 9*c*, and 9*d* illustrated in FIG. 3. The anchor bolts 7 are then inserted into the formed holes and fixed in place using concrete or the like as illustrated in FIG. 2.

Next, the worker performs the device fixing operation to fix the automatic transaction device 1 using the anchor bolts 7. In the device fixing operation using the anchor bolts 7, the automatic transaction device 1 is first installed such that the anchor bolts 7 that have been fixed in the ground 6 pass through the respective anchor bolt holes 9*a*, 9*b*, 9*c*, and 9*d* in the device base plate 3 of the automatic transaction device 1.

Next, as illustrated in FIG. 3, the worker unlocks the door lock 2*a* of the safe door 2 and opens the safe door 2 in the arrow Bx direction. Next, the worker fixes the nuts 8*a* and the washers 8*b* onto each of the anchor bolts 7 that have been passed through the anchor bolt holes 9*a*, 9*b*, 9*c*, and 9*d*. The device fixing operation can be performed easily since the anchor bolt holes 9 in the left and right first gaps L1 are disposed in the vicinity of the device opening 2*b*. When the worker has completed the device fixing operation using the anchor bolts 7, the safe door 2 is closed and locked with the door lock 2*a*. The device fixing operation of the automatic transaction device 1 using the anchor bolts 7 is thus completed in the manner described above.

As described above, in the automatic transaction device 1 according to the first exemplary embodiment, the plural anchor bolt holes 9 are disposed in the device base plate 3 in the vicinity of the device opening 2*b*, in the first gaps L1 formed on the left and right between the device casing 1*x* and the safe unit 5 as viewed from the device opening 2*b*. As a result, the automatic transaction device 1 enables the device fixing operation using the anchor bolts 7 to be performed without pulling out and removing the safe unit 5 and the device internal components 10 already installed inside the device. The automatic transaction device 1 thereby enables the device fixing operation using the anchor bolts 7 to be performed simply and in a short space of time. Furthermore, there is no need to remount the safe unit 5 or the device internal components 10 in the automatic transaction device 1, thereby enabling initial problems due to mistakes arising from such a remounting operation to be prevented.

Second Exemplary Embodiment

Next, explanation follows regarding configuration of an automatic transaction device 1 according to a second exemplary embodiment. The configuration of the automatic transaction device 1 according to the second exemplary embodiment differs in the placement configuration of the anchor bolt holes 9 from that of the automatic transaction device 1 according to the first exemplary embodiment illustrated in FIG. 1. The automatic transaction device 1 according to the second exemplary embodiment is provided with slide rails 11 to move a safe unit 5 outside the device. When the safe unit 5 has been pulled outside the device, a second gap Lα serving as a work-access gap is formed between a device opening 2*b* and a safe unit rear edge 5*b*. Other configuration is similar to the configuration of the automatic transaction device 1 according to the first exemplary embodiment, and explanation regarding such similar configuration is omitted in the interests of brevity.

Figure 4:
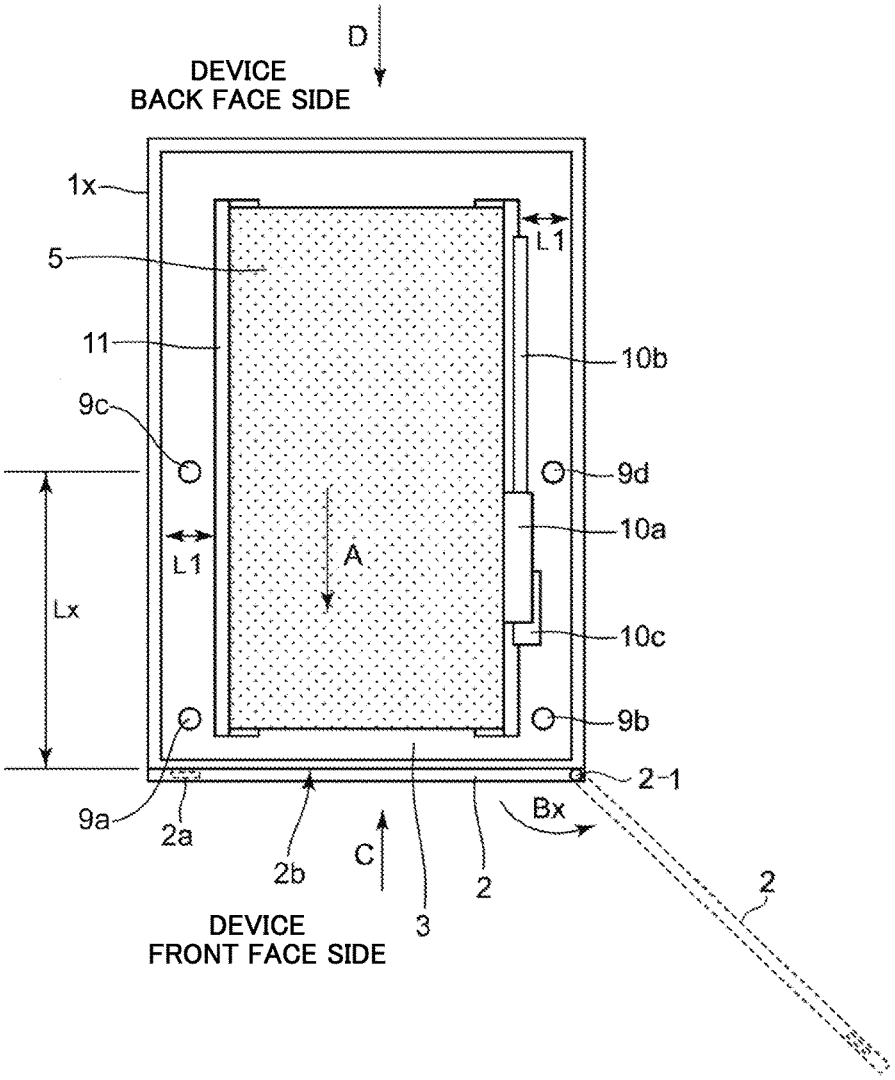
FIG. 4 is an explanatory diagram illustrating the interior of an automatic transaction device according to a second exemplary embodiment, as viewed from above.

First, explanation follows regarding a placement configuration of the anchor bolt holes 9 provided in the device base plate 3, with reference to FIG. 4. FIG. 4 is an explanatory diagram of the interior of the automatic transaction device according to the second exemplary embodiment, as viewed from above. In the device base plate 3 of the automatic transaction device 1 according to the second exemplary embodiment, the anchor bolt holes 9 configuring fixing member holes are not disposed at the backmost positions as viewed from the device opening 2*b*. The anchor bolt holes 9 are disposed in front of the backmost positions, namely toward the device opening 2*b* from the approximate center in the device depth direction. Namely, in the first gaps L1 formed on the left and right between the device casing 1*x* and the safe unit 5, the plural anchor bolt holes 9 are respectively disposed on the left and right in the vicinity of the device opening 2*b* and at the approximate center in the device depth direction.

More specifically, in the first gap L1 between the device casing 1*x* and the safe unit 5 on the device left side, an anchor bolt hole 9*a* is disposed in the vicinity of the device opening 2*b*, and an anchor bolt hole 9*c* is disposed at the approximate center in the device depth direction. In the first gap L1 between the device casing 1*x* and the safe unit 5 on the device right side, an anchor bolt hole 9*b* is disposed in the vicinity of the device opening 2*b*, and an anchor bolt hole 9*d* is disposed at the approximate center in the device depth direction. The anchor bolt holes 9*c* and 9*d* disposed at the approximate center in the device depth direction are disposed at positions that lie at a device depth direction length Lx from the device opening 2*b*. The anchor bolt holes 9*a* and 9*b* disposed in the vicinity of the device opening 2*b* are disposed at similar positions to in the automatic transaction device 1 according to the first exemplary embodiment. Accordingly, in the present exemplary embodiment, the ability to withstand load in the device front-rear direction, namely from the arrow C and arrow D directions, is enhanced by disposing the anchor bolt holes 9*c* and 9*d* at the approximate center in the device depth direction.

The slide rails 11 have a structure allowing the safe unit 5 to be pulled outside the device until the second gap Lα, serving as a gap for work-access illustrated in FIG. 6, described later, is formed between the device opening 2*b* and the safe unit rear edge 5*b*. In the present exemplary embodiment, forming the second gap Lα serving as a work-access gap enables an anchor bolt fixing operation to be performed for the anchor bolt holes 9*c* and 9*d* disposed at the approximate center in the device depth direction.

The second gap Lα is a gap formed between the device opening 2*b* and the safe unit rear edge 5*b* when the safe unit 5 has been pulled out, and is a work-access gap for fixing the anchor bolts 7 to the device base plate 3. In particular, as described later, a left side gap 51 on the device left side of the second gap Lα and a right side gap 52 on the device right side of the second gap Lα are utilized in the device fixing operation.

The device fixing operation using the anchor bolts 7 for the automatic transaction device 1 according to the second exemplary embodiment configured as described above is performed in the following manner. First, a worker performs an anchor bolt fixing operation to fix the anchor bolts 7 in the ground 6. The placement configuration where the anchor bolts 7 are embedded in the anchor bolt fixing operation differs from the placement configuration where the embedded anchor bolts 7 for the automatic transaction device 1 according to the first exemplary embodiment are embedded. Namely, for the automatic transaction device 1 according to the second exemplary embodiment, as illustrated in FIG. 4, in the first gap L1 on the device left side, the anchor bolt hole 9*a* is disposed in the vicinity of the device opening 2*b* and the anchor bolt hole 9*c* is disposed at the approximate center in the device depth direction. In the first gap L1 on the device right side, the anchor bolt hole 9*b* is disposed in the vicinity of the device opening 2*b* and the anchor bolt hole 9*d* is disposed at the approximate center in the device depth direction. Accordingly, the worker embeds the respective anchor bolts 7 according to the placement configuration of the anchor bolt holes 9*a*, 9*b*, 9*c*, and 9*d*. The operation to fix the anchor bolts 7 in the ground 6 is similar to the operation described with reference to FIG. 2 in the explanation of the automatic transaction device 1 according to the first exemplary embodiment, and so explanation thereof is omitted in the interests of brevity.

Next, the worker performs the device fixing operation to fix the automatic transaction device 1 using the anchor bolts 7. In the device fixing operation using the anchor bolts 7, the automatic transaction device 1 is first installed such that the anchor bolts 7 fixed in the ground 6 pass through the respective anchor bolt holes 9*a*, 9*b*, 9*c*, and 9*d* in the device base plate 3 of the automatic transaction device 1. The worker then unlocks the door lock 2*a* of the safe door 2 and opens the safe door 2 in the arrow Bx direction as illustrated by the dashed lines in FIG. 4.

Figure 5:
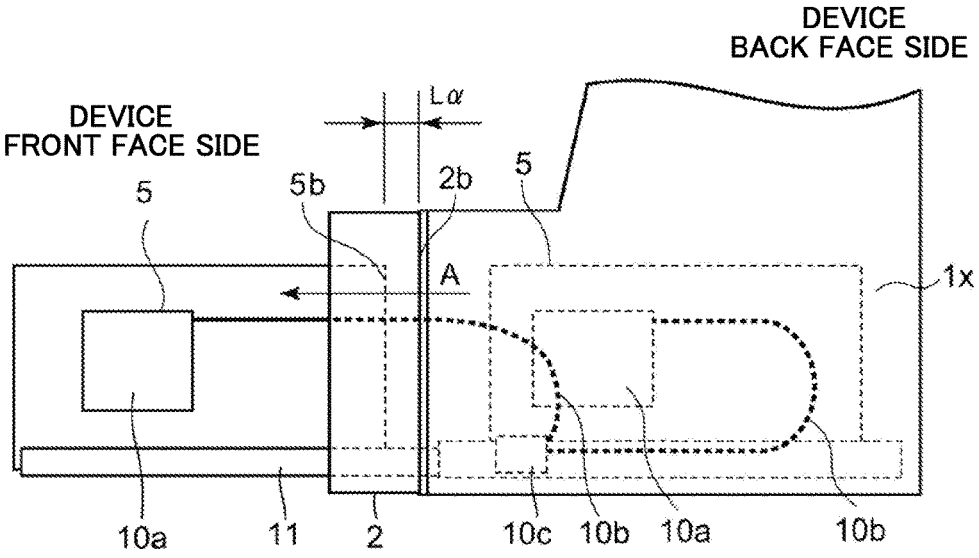
FIG. 5 is a side view illustrating an action to pull out a safe unit of an automatic transaction device according to the second exemplary embodiment.

Next, the worker pulls the safe unit 5 outside the device by sliding the safe unit 5 in the arrow A direction using the slide rails 11. FIG. 5 is a side view illustrating an action to pull out the safe unit of the automatic transaction device according to the second exemplary embodiment. Note that FIG. 5 illustrates a state in which the safe door 2 has been opened. As illustrated in FIG. 5, the safe unit 5 inside the device illustrated by dashed lines is pulled outside the device by sliding the safe unit 5 in the arrow A direction as far as the position illustrated by solid lines. When this is performed, the control board 10*a* and the wiring member 10*b* fixed to the right side face of the safe unit 5 are pulled out together with the safe unit 5, however, the connector 10*c* remains fixed inside the device. When the safe unit 5 has been pulled outside the device using the slide rails 11, the second gap Lα serving as a work-access gap is formed between the device opening 2*b* and the safe unit rear edge 5*b*.

Next, the worker performs an operation to fix the respective anchor bolts 7 that have been passed through the anchor bolt holes 9*a*, 9*b*, 9*c*, and 9*d*. FIG. 6 is an explanatory diagram illustrating the device fixing operation using anchor bolts for the automatic transaction device according to the second exemplary embodiment. As illustrated in FIG. 6, the safe unit 5 is pulled out in the arrow A direction to form the second gap Lα, serving as a work-access gap to fix the anchor bolts 7 to the device base plate 3, between the device opening 2*b* and the safe unit rear edge 5*b*. In particular, the left side gap 51 illustrated by dashed lines is formed on the device left side of the second gap Lα and the right side gap 52 illustrated by dashed lines is formed on the device right side of the second gap Lα.

Figure 7:
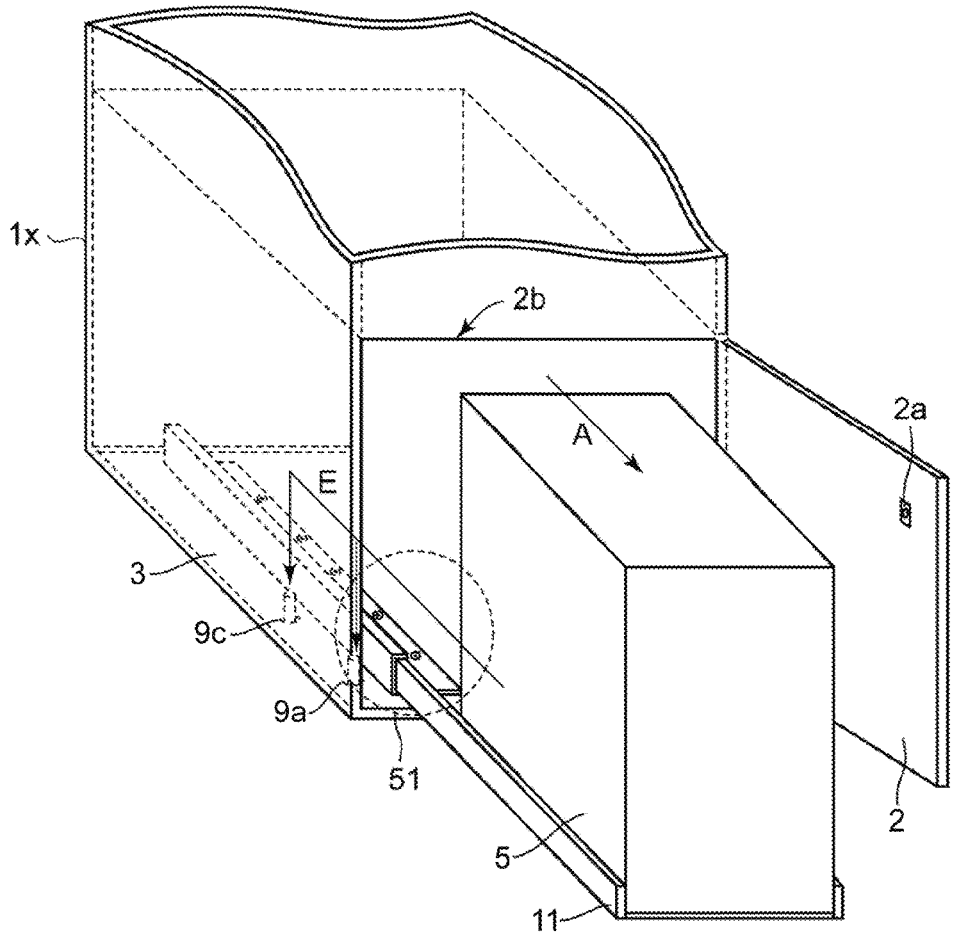
FIG. 7 is a perspective view illustrating a device fixing operation using anchor bolts for an automatic transaction device according to the second exemplary embodiment.

The worker then inserts his right arm through the left side gap 51 on the device left side, and fixes nuts 8*a* and washers 8*b* to the respective anchor bolts 7 that have been passed through the anchor bolt holes 9*a* and 9*c*. FIG. 7 is a perspective view illustrating the device fixing operation using anchor bolts for the automatic transaction device according to the second exemplary embodiment.

As illustrated in FIG. 7, since the control board 10*a* and the wiring member 10*b* are not disposed in the left side gap 51, the worker can easily insert his right arm through the left side gap 51. By stretching his right arm in the arrow E direction, the worker is easily able to fix the respective anchor bolts 7 that have been passed through the anchor bolt holes 9*a* and 9*c* using the nuts 8*a* and the washers 8*b*.

Figure 6:
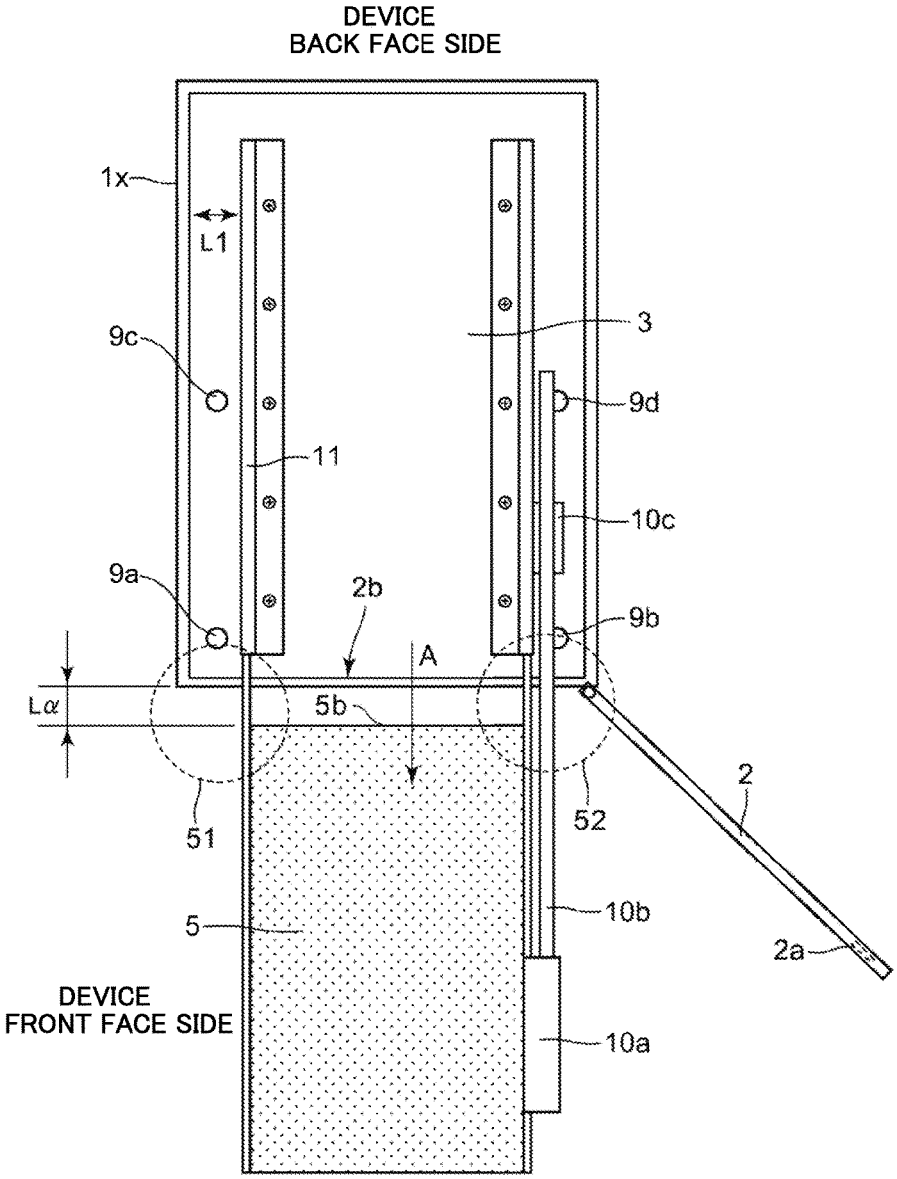
FIG. 6 is an explanatory diagram illustrating a device fixing operation using anchor bolts for an automatic transaction device according to the second exemplary embodiment.
Figure 8:
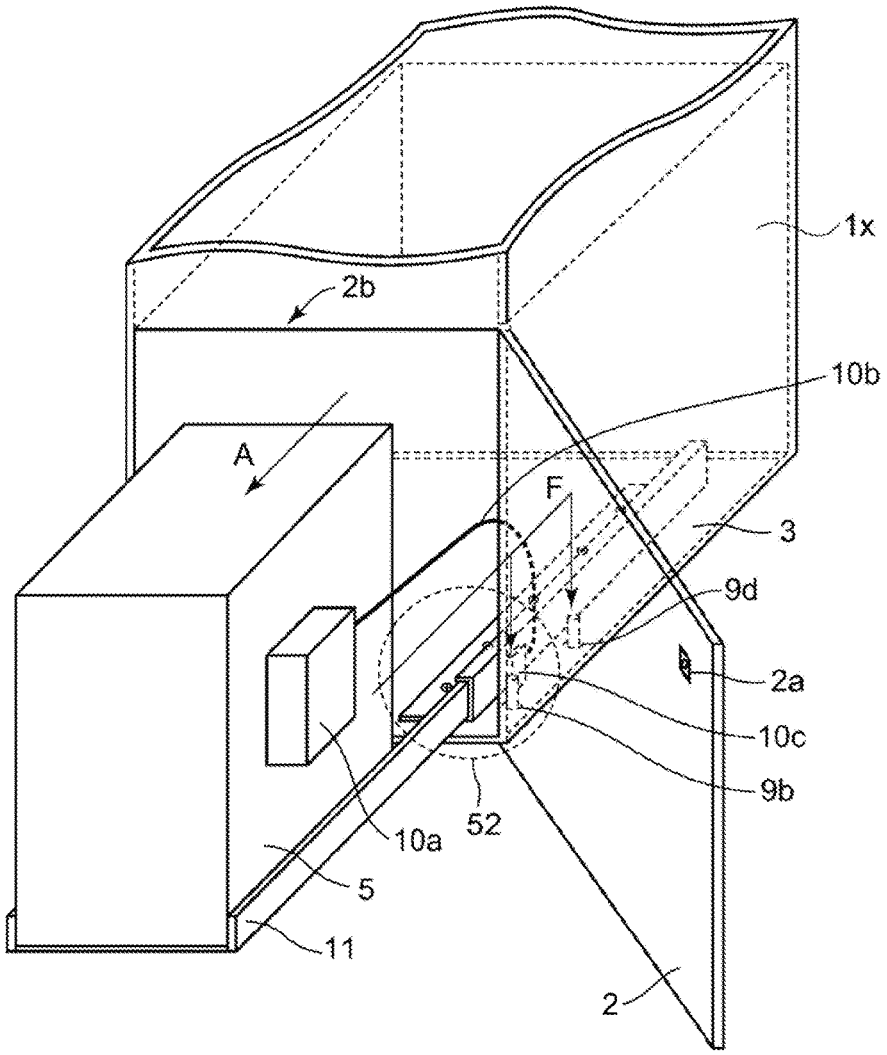
FIG. 8 is a perspective view illustrating a device fixing operation using anchor bolts for an automatic transaction device according to the second exemplary embodiment.

Next, the worker inserts his left arm through the right side gap 52 on the device right side, illustrated in FIG. 6, and fixes the respective anchor bolts 7 that have been passed through the anchor bolt holes 9*b* and 9*d* using the nuts 8*a* and the washers 8*b*. FIG. 8 is a perspective view illustrating the device fixing operation using anchor bolts for the automatic transaction device according to the second exemplary embodiment.

As illustrated in FIG. 8, the control board 10*a* is provided on the right side face of the safe unit 5 at a position slightly toward the device opening 2*b* of the approximate center in the device depth direction. Accordingly, when the safe unit 5 is slid, the control board 10*a* leaves the right side gap 52, and the worker can easily insert his left arm through the device right side. The worker is able to fix the respective anchor bolts 7 that have been passed through the anchor bolt holes 9*b* and 9*d* by stretching his left arm in the arrow F direction while avoiding the control board 10*a* and the wiring member 10*b*.

When the device fixing operation using the anchor bolts 7 is finished, the worker slides the safe unit 5 using the slide rails 11 so as to push and fix the safe unit 5 inside the device. The safe door 2 is then closed and locked with the door lock 2*a*. The device fixing operation using the anchor bolts 7 for the automatic transaction device 1 is thus completed.

Note that explanation has been given of a case in which, for the anchor bolt holes 9*a* and 9*b* disposed in the vicinity of the device opening 2*b*, the worker performs the device fixing operation using the anchor bolts 7 after pulling out the safe unit 5. However, the device fixing operation using the anchor bolts 7 may be performed before the worker pulls out the safe unit 5. Namely, the anchor bolts 7 that have been passed through the anchor bolt holes 9*a* and 9*b* disposed in the vicinity of the device opening 2*b* may be fixed by the nuts 8*a* and the washers 8*b* before the worker pulls out the safe unit 5. Next, the worker pulls out the safe unit 5, and fixes the anchor bolts 7 that have been passed through the anchor bolt holes 9*c* and 9*d* with the nuts 8*a* and the washers 8*b*.

Fixing the anchor bolts 7 for the anchor bolt holes 9*a* and 9*b* disposed in the vicinity of the device opening 2*b* prior to pulling out the safe unit 5 enables the automatic transaction device 1 to be prevented from falling over when pulling out the safe unit 5.

As described above, in the automatic transaction device 1 according to the second exemplary embodiment, in the first gaps L1 formed between the device casing 1*x* and the safe unit 5 on the left and right as viewed from the device opening 2*b*, the anchor bolt holes 9*a* and 9*b* are disposed in the vicinity of the device opening 2*b*, and also the anchor bolt holes 9*c* and 9*d* are disposed at the approximate center in the device depth direction. Moreover, the automatic transaction device 1 according to the second exemplary embodiment has a structure in which the safe unit 5 is pulled outside the device using the slide rails 11 to form the second gap Lα for work-access to fix the anchor bolts 7 to the device base plate 3, between the device opening 2*b* and the safe unit rear edge 5*b*. Accordingly, in addition to the effects of the automatic transaction device 1 according to the first exemplary embodiment, the automatic transaction device 1 according to the second exemplary embodiment is capable of enhancing the load withstanding ability of the automatic transaction device 1.

Third Exemplary Embodiment

Next, explanation follows regarding configuration of an automatic transaction device 1 according to a third exemplary embodiment. In the automatic transaction device 1 according to the third exemplary embodiment, the placement configuration of the anchor bolt holes 9 is the same as that in the automatic transaction device 1 according to the first exemplary embodiment illustrated in FIG. 1. Moreover, the automatic transaction device 1 according to the third exemplary embodiment is provided with slide rails 11 to move a safe unit 5 outside the device, similarly to in the automatic transaction device 1 according to the second exemplary embodiment. The slide rails 11 have a structure allowing the safe unit 5 to be pulled outside the device until a second gap Lα, serving as a work-access gap to fix anchor bolts 7 to a device base plate 3, is formed between a device opening 2*b* and a safe unit rear edge 5*b*. Other configuration is similar to the configuration of the automatic transaction device 1 according to the first exemplary embodiment, and explanation regarding such similar configurations is omitted in the interests of brevity.

Figure 9:
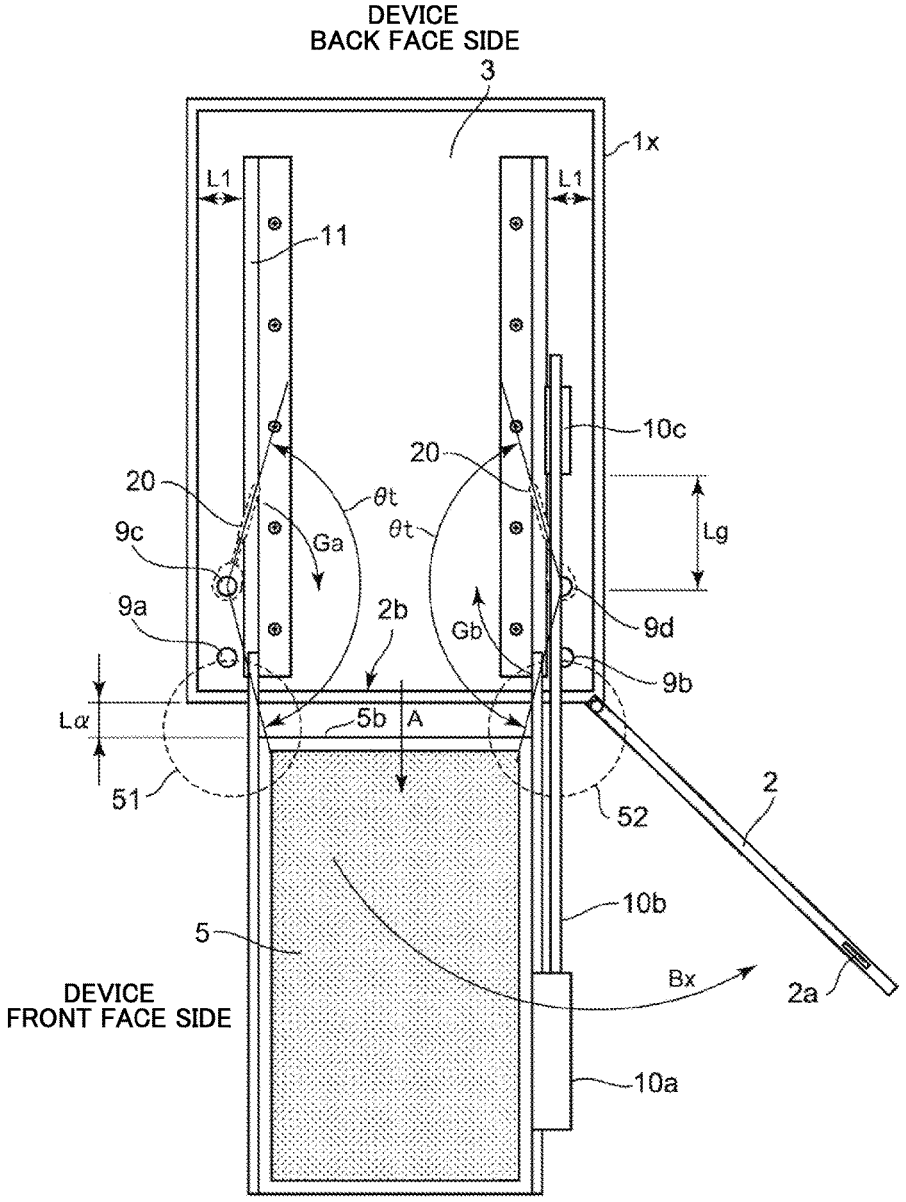
FIG. 9 is an explanatory diagram illustrating the interior of an automatic transaction device according to a third exemplary embodiment, as viewed from above.

First, explanation follows regarding the placement configuration of the anchor bolt holes 9 configuring holes for fixing members in the automatic transaction device 1, with reference to FIG. 9. FIG. 9 is an explanatory diagram of the interior of the automatic transaction device according to the third exemplary embodiment, as viewed from above. Note that FIG. 9 illustrates a state in which the safe door 2 has been opened in the arrow Bx direction, and the safe unit 5 has been pulled out by sliding the safe unit 5 in the arrow A direction using the slide rails 11.

Similarly to in the first exemplary embodiment, the anchor bolt holes 9*a*, 9*b*, 9*c*, and 9*d* according to the third exemplary embodiment are disposed in the device base plate 3, with two each being disposed on the left and right in the vicinity of the device opening 2*b* in the first gaps L1 formed on the left and right between the device casing 1*x* and the safe unit 5. Namely, the anchor bolt holes 9*a* and 9*c* are disposed in the first gap L1 on the device left side as viewed from the device opening 2*b*, and the anchor bolt holes 9*b* and 9*d* are disposed in the first gap L1 on the device right side. The anchor bolt holes 9*a* and 9*b* are disposed in close proximity to the device opening 2*b*, and the anchor bolt holes 9*c* and 9*d* are disposed slightly further away from the device opening 2*b*.

In the automatic transaction device 1 according to the third exemplary embodiment, the safe unit 5 is pulled out using the slide rails 11 to form a second gap Lα serving as a work-access gap. In the automatic transaction device 1 according to the third exemplary embodiment, a left side gap 51 is formed on the device left side and a right side gap 52 is formed on the device right side, thereby enabling an anchor bolt fixing operation to be performed at the anchor bolt holes 9*c* and 9*d* disposed slightly further away from the device opening 2*b*.

In FIG. 9, an attachment tool 20, described later, is illustrated by dashed lines at the periphery of the anchor bolt holes 9*c* and 9*d*. The automatic transaction device 1 according to the third exemplary embodiment is an example in which a device internal component fixed to the device base plate 3, namely the connector 10*c* serving as a fixed device internal component, is disposed at the approximate center in the device depth direction.

Similarly to the automatic transaction device 1 according to the first exemplary embodiment, an operation to fix the anchor bolts 7 is performed by fixing the respective anchor bolts 7 that have been passed through the anchor bolt holes 9 using nuts 8*a* and washers 8*b*. In the automatic transaction device 1 according to the third exemplary embodiment, the attachment tool 20 is employed to tighten the nuts 8*a*. A socket wrench, a spanner, a monkey wrench, or the like may all be employed as the attachment tool 20, and in particular, an easy-to-use socket wrench may be employed for working in the vicinity of the device casing 1*x*.

Figure 10:
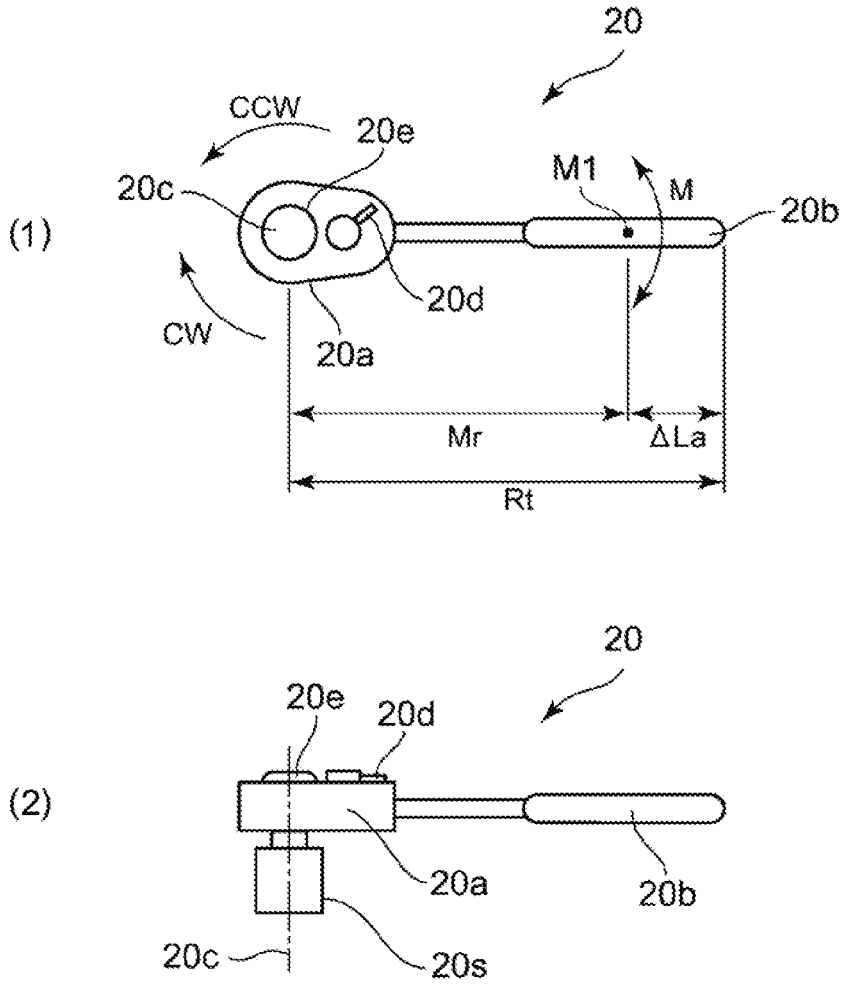
FIG. 10 is an explanatory diagram illustrating an attachment tool employed with an automatic transaction device according to the third exemplary embodiment.

FIG. 10 is an explanatory diagram of the attachment tool employed with the automatic transaction device according to the third exemplary embodiment. Note that FIG. 10 (1) is a plan view of the attachment tool 20, and FIG. 10 (2) is a side view of the attachment tool 20. The attachment tool 20 is configured from a socket mount 20*a*, a handle 20*b*, a setting lever 20*d*, and a release button 20*e*. The attachment tool 20 is capable of rotating a nut 8*a* mounted in the socket mount 20*a* by rotating the handle 20*b* in forward and backward directions about the socket mount 20*a*, namely by a forward and backward action.

The socket mount 20*a* has an inbuilt ratchet mechanism that allows the nut 8*a* configuring a tightened member to be rotated by a predetermined rotation amount in a set direction, and that free-rotates when rotated in the opposite direction. A socket 20*s* approximately selected according to the size of the nut 8*a* can be mounted to the socket mount 20*a*.

The handle 20*b* is a portion that is held by the worker when operating the attachment tool 20 in a forward and backward action. The setting lever 20*d* is a lever used to set the direction to rotate the nut 8*a* in, to either a CW direction (clockwise direction) or a CCW direction (counterclockwise direction). The release button 20*e* is a button that is pressed in order to release the mounted socket 20*s* from the socket mount 20*a*.

A tool rotation radius Rt refers to the radius of rotation of the attachment tool 20 about a pivot of a rotation center 20*c* of the attachment tool 20. An operation radius Mr is the length of a moment arm, namely a radius corresponding to a point of action M1 of tensile load or pressing load from the hand of the worker. A surplus end length ΔLa is the surplus length from the point of action M1 to a leading end of the handle 20*b*. Note that in tests, the surplus end length ΔLa was not greater than 4 cm, even for adult males.

When a socket wrench is employed as the attachment tool 20, the nut 8*a* can be rotated, about the rotation center 20*c* as the pivot, and tightened simply by moving the handle 20*b* forward and backward in the arrow M direction.

Namely, the worker sets the setting lever 20*d* in the direction to tighten the nut 8*a*. Normally, a right-handed thread would be applied to the anchor bolts 7, and so the CW direction (clockwise direction) is set. Next, a socket 20*s* appropriate to the nut 8*a* is mounted to the socket mount 20*a*. The socket 20*s* is then fitted over the nut 8*a* and the handle 20*b* is gripped and moved forward and backward in the arrow M direction, thereby enabling the nut 8*a* to be tightened.

Returning once more to FIG. 9, in the anchor bolt fixing operation for the automatic transaction device 1 according to the third exemplary embodiment, the attachment tool 20 described above is operated in a forward and backward action by being rotated in a substantially horizontally direction in the arrow Ga or Gb direction before being returned to its original position, so as to rotate and tighten the nut 8*a*.

When this is performed, a rotation angle θt of the attachment tool 20 is most preferably approximately 180° in consideration of the ease of operation when tightening the nut 8*a* in the vicinity of the device casing 1*x*, namely in consideration of the number of forward and backward actions performed.

In the automatic transaction device 1 according to the third exemplary embodiment, the anchor bolt hole 9*d* that is disposed slightly further away from the device opening 2*b* on the device right side, where the device internal components 10 are disposed, is disposed such that the attachment tool 20 does not interfere with the connector 10*c* of the device internal components 10 when rotating the attachment tool 20.

Specifically, for example, the position of the anchor bolt hole 9*d* is disposed separated by a separation distance Lg toward the device opening 2*b* from the connector 10*c*, in order to enable the attachment tool 20 to be rotated through approximately 180°. The separation distance Lg is set to no less than approximately the tool rotation radius Rt of the attachment tool 20.

Moreover, on the device left side, in order to achieve similar operation to on the device right side, the anchor bolt hole 9*c* that is disposed slightly further away from the device opening 2*b* on the device left side, is disposed at a position having left-right symmetry to the anchor bolt hole 9*d*.

The tightness of the nut 8*a* should satisfy Equation 1, in which standard tightening torque for a T-series standard (general use) screw is Ts (N·m), the pushing force or pulling force applied by the arm of an adult worker is Fp (kgf), and the operation radius by the worker is Mr (cm). Namely, $$Mr(cm) \geq (Ts(Nm) \times 10.2)/Fp(\text{kgf}) \quad \text{(Equation 1)}$$

When employing a M8 thread for the anchor bolts 7 used to fix the automatic transaction device 1 to the ground 6, the torque Ts of the standard tightening torque for T-series standard (general use) is 12.5 N·m. In testing, the pushing force or pulling force Fp from the arm of an adult is approximately 9 kgf on average when using the dominant arm, and 8 kgf or greater on average when using the non-dominant arm.

When the pushing force or pulling force of the worker is 8 kgf based on the above measurement results, the operation radius Mr (cm)≥approximately 15.6 cm according to Equation 1. Accordingly, even considering 4 cm for the surplus end length ΔLa illustrated in FIG. 10, a tool rotation radius Rt of approximately 20 cm is sufficient.

Namely, the position of the anchor bolt hole 9*d* slightly further away from the device opening 2*b* should be set so as not to interfere with the connector 10*c* that is a fixed device internal component when using the attachment tool 20 having a tool rotation radius Rt of approximately 20 cm. Accordingly, the position of the anchor bolt hole 9*d* is disposed at a position separated by a separation distance Lg of no less than approximately 20 cm, this corresponding to the approximate tool rotation radius Rt, from the fixed device internal component of the connector 10*c*.

The device fixing operation using the anchor bolts 7 for the automatic transaction device 1 according to the third exemplary embodiment, configured as described above, is performed in the following manner. First, a worker performs the anchor bolt fixing operation to fix the anchor bolts 7 in the ground 6. In the automatic transaction device 1 according to the third exemplary embodiment, as illustrated in FIG. 9, the anchor bolt hole 9*d* is disposed separated from the fixed device component of the connector 10*c* by the separation distance Lg. The anchor bolt hole 9*c* is also disposed at a similar position. The worker embeds the respective anchor bolts 7 in consideration of this placement configuration. Note that the operation to fix the anchor bolts 7 in the ground 6 is similar to that of the automatic transaction device 1 according to the first exemplary embodiment, and so explanation thereof is omitted in the interests of brevity.

Next, the worker performs a device fixing operation to fix the automatic transaction device 1 using the anchor bolts 7. In the device fixing operation using the anchor bolts 7, the automatic transaction device 1 is first installed such that the plural anchor bolts 7 fixed in the ground 6 pass through the respective plural anchor bolt holes 9*a*, 9*b*, 9*c*, and 9*d* provided through the device base plate 3 of the automatic transaction device 1. The worker then unlocks the door lock 2*a* of the safe door 2 and opens the safe door 2 in the arrow Bx direction.

Next, the worker pulls the safe unit 5 outside the device by sliding the safe unit 5 in the arrow A direction using the slide rails 11. When the safe unit 5 has been pulled outside the device using the slide rails 11, a second gap Lα, serving as a work-access gap to fix the anchor bolts 7 to the device base plate 3, is formed between the device opening 2*b* and the safe unit rear edge 5*b*. In particular, a left side gap 51 is formed on the device left side and a right side gap 52 is formed on the device right side.

Next, the worker performs an operation to fix the respective anchor bolts 7 that have been passed through the anchor bolt holes 9*a*, 9*b*, 9*c*, and 9*d*. First, the worker inserts his right arm through the left side gap 51 on the device left side, and fixes the respective anchor bolts 7 that have been passed through the anchor bolt holes 9*a* and 9*c* using nuts 8*a* and washers 8*b*. The nuts 8*a* are tightened using the attachment tool 20 illustrated in FIG. 10.

Figure 11:
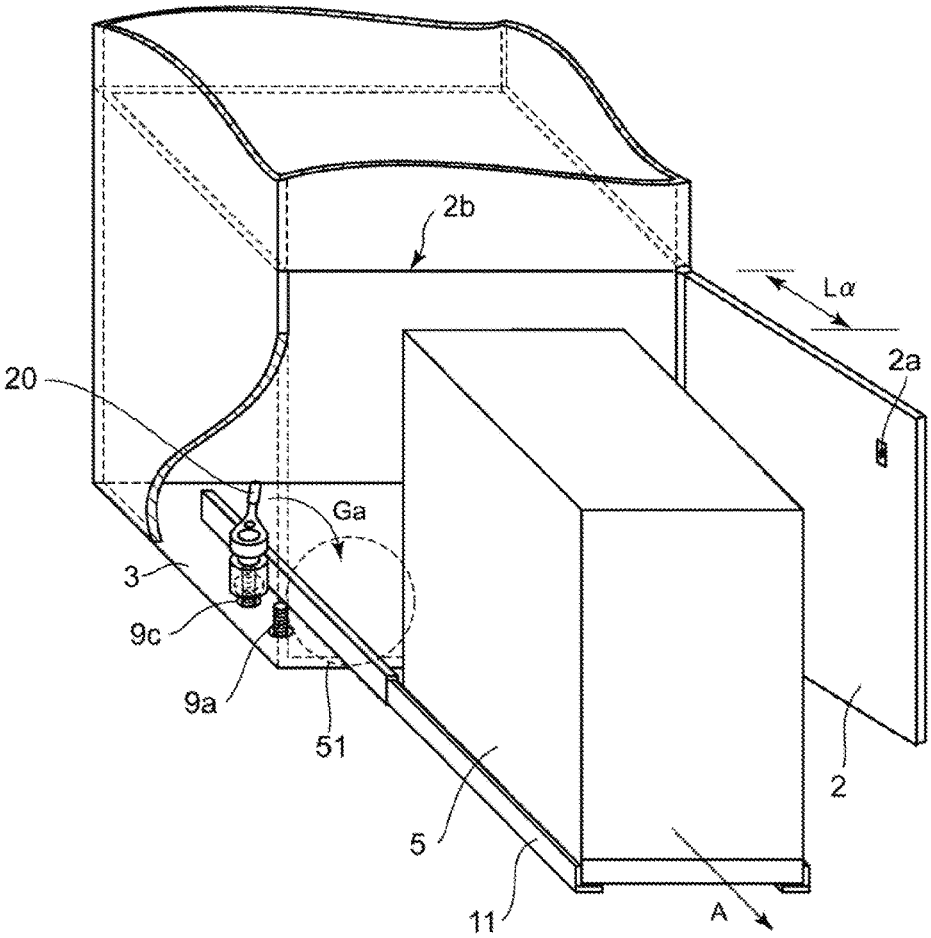
FIG. 11 is a partially cut-away perspective view illustrating a device fixing operation using anchor bolts for an automatic transaction device according to the third exemplary embodiment.

FIG. 11 is a partially cut-away perspective view illustrating the device fixing operation using the anchor bolts in the automatic transaction device according to the third exemplary embodiment. Note that FIG. 11 illustrates a case in which the anchor bolt 7 that has been passed through the anchor bolt hole 9*c* disposed slightly further away from the device opening 2*b* is being fixed; however, the same applies in a case in which the anchor bolt 7 that has been passed through the anchor bolt hole 9*a* disposed in close proximity to the device opening 2*b* is being fixed.

As illustrated in FIG. 11, since the control board 10*a* and the wiring member 10*b* are not disposed in the left side gap 51 on the device left side, it is easy for the worker to insert his right arm at the device left side. The worker inserts his right arm through the left side gap 51 on the device left side, illustrated by dashed lines, and loosely fixes the nuts 8*a* and the washers 8*b*. Next, the worker tightens and fixes the nuts 8*a* using the attachment tool 20.

This tightening is performed by push-fitting the socket 20*s* attached to the socket mount 20*a* of the attachment tool 20 onto the nut 8*a*, and rotating the handle 20*b* in a substantially horizontal direction. In the left side gap 51, the worker repeatedly performs a forward and backward action to tighten the nut 8*a* by repeated actions of rotating the attachment tool 20 from the device back side by approximately 180° in the arrow Ga direction to the vicinity of the device opening 2*b* so as to tighten the nut 8*a*, and free-rotating the attachment tool 20 back in the opposite direction to the arrow Ga.

Figure 12:
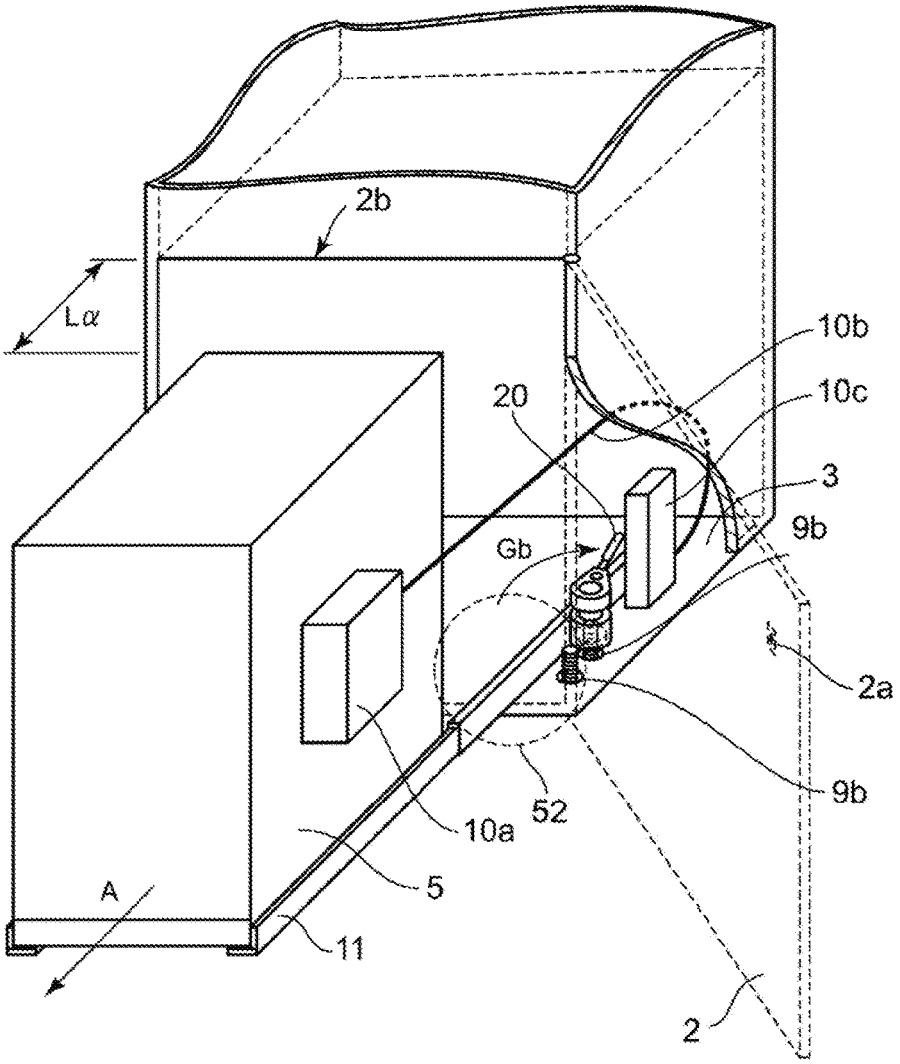
FIG. 12 is a partially cut-away perspective view illustrating a device fixing operation using anchor bolts for an automatic transaction device according to the third exemplary embodiment.

Next, the worker inserts his left arm through the right side gap 52 on the device right side, illustrated in FIG. 12, and fixes the respective anchor bolts 7 that have been passed through the anchor bolt holes 9*b* and 9*d* using the nuts 8*a* and the washers 8*b*.

FIG. 12 is a partially cut-away perspective view illustrating the device fixing operation using the anchor bolts in the automatic transaction device according to the third exemplary embodiment. Note that FIG. 12 illustrates a case in which the anchor bolt 7 that has been passed through the anchor bolt hole 9*d* disposed slightly further away from the device opening 2*b* is being fixed; however, the same applies in a case in which the anchor bolt 7 that has been passed through the anchor bolt hole 9*b* disposed in close proximity to the device opening 2*b* is being fixed.

As illustrated in FIG. 12, the control board 10*a* is provided on the right side face of the safe unit 5, fixed slightly toward the device opening 2*b* from the approximate center in the device depth direction. Accordingly, when the safe unit 5 is slid so as to form the second gap Lα, the control board 10*a* leaves the right side gap 52, and it is easy for the worker to insert his left arm at the device right side. The worker is able to fix the respective anchor bolts 7 that have been passed through the anchor bolt hole 9*b* and 9*d* by using his left arm while avoiding the control board 10*a* and the wiring member 10*b*.

At the device right side, the worker repeatedly performs a forward and backward action to tighten the nut 8*a* by repeated actions of rotating the attachment tool 20 from the device opening 2*b* side approximately 180° in the arrow Gb direction to the device back side so as to tighten the nut 8, and free-rotating the attachment tool 20 back in the opposite direction to the arrow Gb.

When this is performed, the anchor bolt hole 9*d* is disposed at a position separated by the separation distance Lg from the connector 10*c* serving as a fixed device internal component. The worker therefore does not interfere with the fixed device internal component when rotating the attachment tool 20 approximately 180°.

When the device fixing operation using the anchor bolts 7 is finished, the worker slides the safe unit 5 using the slide rails 11 so as to push and fix the safe unit 5 inside the device. The worker then closes the safe door 2 and locks the door lock 2*a*. The device fixing operation using the anchor bolts 7 for the automatic transaction device 1 is thus completed.

Note that the foregoing explanation describes the worker performing the device fixing operation using the anchor bolts 7 at the anchor bolt holes 9*a* and 9*b* disposed in the vicinity of the device opening 2*b* after pulling out the safe unit 5. However, this device fixing operation may be performed before pulling out the safe unit 5. Namely, before pulling out the safe unit 5, the worker fixes the anchor bolts 7 that have been passed through the anchor bolt holes 9*a* and 9*b* disposed in the vicinity of the device opening 2*b* using the nuts 8*a* and the washers 8*b*. Next, after pulling out the safe unit 5, the worker fixes the respective anchor bolts 7 that have been passed through the anchor bolt holes 9*c* and 9*d* using the nuts 8*a* and the washers 8*b*.

By fixing the anchor bolts 7 at the anchor bolt holes 9*a* and 9*b* disposed in the vicinity of the device opening 2*b* before pulling out the safe unit 5, the worker is able to prevent the automatic transaction device 1 tilting over when pulling out the safe unit 5.

Moreover, the foregoing explanation describes a case in which the anchor bolt hole 9*c* on the device left side, where there are no fixed device components that might interfere with the attachment tool 20 present, is disposed at a position having left-right symmetry to the anchor bolt hole 9*d*. However, the anchor bolt hole 9*c* disposed slightly further away from the device opening 2*b* may be disposed further toward the device back side as long as the attachment tool 20 can be rotated approximately 180°.

As described above, in the automatic transaction device 1 according to the third exemplary embodiment, in the vicinity of the device opening 2*b* in the first gaps L1 between the device casing 1*x* and the safe unit 5 on the left and right as viewed from the device opening 2*b*, the anchor bolt hole 9*d* is disposed at a position toward the device opening 2*b* and separated by no less than the approximately tool rotation radius Rt of the attachment tool 20 from the connector 10*c* serving as a fixed device internal component. As a result, in the automatic transaction device 1 according to the third exemplary embodiment, the device fixing operation using the anchor bolts 7 can be performed efficiently without removing the safe unit 5 and the device internal components 10 installed inside the device. As a result, in addition to the effects of the automatic transaction device 1 according to the first exemplary embodiment, the automatic transaction device 1 according to the third exemplary embodiment thereby enables a device fixing operation employing an attachment tool to be performed even more simply and in a shorter space of time.

Fourth Exemplary Embodiment

Next, explanation follows regarding configuration of an automatic transaction device 1 according to a fourth exemplary embodiment. The configuration of the automatic transaction device 1 according to the fourth exemplary embodiment differs from that of the automatic transaction device 1 according to the third exemplary embodiment illustrated in FIG. 9 in the placement configuration of the anchor bolt holes 9. The automatic transaction device 1 according to the fourth exemplary embodiment is provided with slide rails 11 to move a safe unit 5 outside the device, similarly to in the automatic transaction device 1 according to the second exemplary embodiment. The automatic transaction device 1 according to the fourth exemplary embodiment has a structure in which the safe unit 5 is pulled outside the device until a second gap Lα, serving as a work-access gap, is formed between a device opening 2*b* and a safe unit rear edge 5*b*. Other configuration is similar to the configuration of the automatic transaction device 1 according to the first exemplary embodiment, and explanation regarding such similar configuration is omitted in the interests of brevity.

Figure 13:
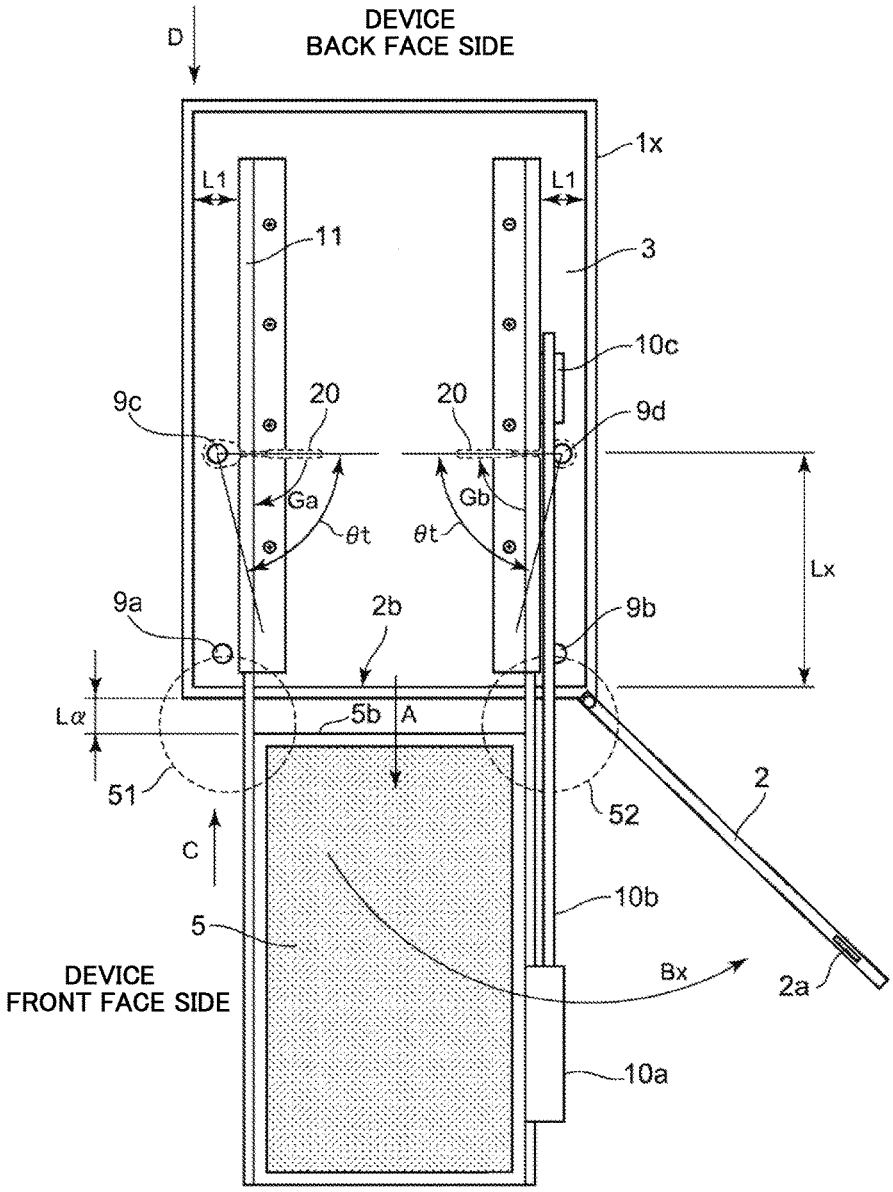
FIG. 13 is an explanatory diagram illustrating the interior of an automatic transaction device according to a fourth exemplary embodiment, as viewed from above.

First, explanation follows regarding the placement configuration of the anchor bolt holes 9 provided in the device base plate 3, with reference to FIG. 13. FIG. 13 is an explanatory diagram of the interior of the automatic transaction device according to the fourth exemplary embodiment, as viewed from above. Note that FIG. 13 illustrates a state in which a safe door 2 has been opened in the arrow Bx direction, and the safe unit 5 has been pulled out by sliding along the arrow A direction using the slide rails 11. In the automatic transaction device 1 according to the fourth exemplary embodiment, the safe unit 5 is pulled out using the slide rails 11 to form the second gap Lα. This enables an anchor bolt fixing operation to be performed at anchor bolt holes 9*c* and 9*d* that are disposed at the approximate center in the device depth direction.

In the device base plate 3 of the automatic transaction device 1, similarly to in the device base plate 3 of the automatic transaction device 1 according to the second exemplary embodiment, the anchor bolt holes 9*a* and 9*b* are disposed in the vicinity of the device opening 2*b*, and the anchor bolt holes 9*c* and 9*d* are disposed at the approximate center in the device depth direction. In FIG. 13, an attachment tool 20 (see FIG. 10) is illustrated by dashed lines at the periphery of the anchor bolt holes 9*c* and 9*d*. In the automatic transaction device 1 according to the fourth exemplary embodiment, a wiring member 10*b* and a connector 10*c* configuring fixed device internal components 10 are disposed at the approximate center in the device depth direction.

Similarly to as described in relation to the third exemplary embodiment, an operation to fix the anchor bolts 7 that have been passed through the anchor bolt holes 9*a*, 9*b*, 9*c*, and 9*d* is performed by fixing the respective anchor bolts 7 using nuts 8*a* and washers 8*b*. Regarding the attachment tool 20 used the tighten the nut 8*a*, similarly to as described in relation to the third exemplary embodiment, an easy-to-use socket wrench is employed as the attachment tool 20. Tightening of the nuts 8*a* using the attachment tool 20 is performed by rotating the attachment tool 20 in a substantially horizontal direction in the arrow Ga direction or the arrow Gb direction illustrated in FIG. 13.

The rotating action of the attachment tool 20 in the operation to tighten the nuts 8*a* should not interfere with the device internal components 10, the wiring member 10*b* and the connector 10*c*. However, if a rotation angle θt of at least approximately 90° is not achieved for the attachment tool 20 then the number of forward and backward actions increases and operational efficiency suffers. Moreover, force is more easy to apply when the attachment tool 20 is at right angles to a device front face direction (arrow D direction), and there is therefore a need for the hand of a worker to reach the handle 20*b* of the attachment tool 20 at this point.

For such reasons, the anchor bolt holes 9*c* and 9*d* at the approximate center in the device depth direction of the automatic transaction device 1 according to the fourth exemplary embodiment are disposed at a device depth direction length Lx that enables the attachment tool 20 to be rotated through approximately 90° and that is within approximately an arm's length range of an adult from the device opening 2*b*.

Moreover, since the distance from the elbow to the center of a fist of an adult worker is approximately 30 cm, the device depth direction length Lx to the anchor bolt holes 9*c*, 9*d* at the approximate center in the device depth direction may be in the region of approximately 30 cm.

In tests, when the second gap Lα was set to approximately 10 cm, the average distance Lx at which an adult male was able to perform a device fixing operation using the anchor bolts 7 was approximately 50 cm. Accordingly, the device depth direction length Lx to the anchor bolt holes 9*c*, 9*d* at the approximate center in the device depth direction is preferably approximately 50 cm, even if some operational efficiency is sacrificed.

Disposing the anchor bolt holes 9*c*, 9*d* at the approximate center in the device depth direction as described above enables the ability to withstand load in the device front-rear directions, namely from the arrow C and D directions, to be enhanced.

The device fixing operation using the anchor bolts 7 in the automatic transaction device 1 according to the fourth exemplary embodiment configured as described above is performed in the following manner. First, a worker performs an anchor bolt fixing operation to fix the anchor bolts 7 in the ground 6. In the automatic transaction device 1 according to the fourth exemplary embodiment, as illustrated in FIG. 13, the attachment tool 20 can be rotated through approximately 90° at the anchor bolt holes 9*c*, 9*d* disposed at the approximate center in the device depth direction, and the anchor bolt holes 9*c*, 9*d* are disposed at the device depth direction length Lx, which is within an arm's length range of a typical adult, from the device opening 2*b*. The worker embeds the respective anchor bolts 7 in consideration of this placement configuration. Note that the operation to fix the anchor bolts 7 in the ground 6 is similar to that of the automatic transaction device 1 according to the first exemplary embodiment, and so explanation thereof is omitted in the interests of brevity.

Next, the worker performs a device fixing operation to fix the automatic transaction device 1 using the anchor bolts 7. In the device fixing operation using the anchor bolts 7, the worker first installs the automatic transaction device 1 such that the plural anchor bolts 7 fixed in the ground 6 pass through the respective anchor bolt holes 9*a*, 9*b*, 9*c*, and 9*d* in the device base plate 3 of the automatic transaction device 1. The worker then unlocks the door lock 2*a* of the safe door 2 and opens the safe door 2 in the arrow Bx direction.

Next, the worker pulls the safe unit 5 outside the device by sliding the safe unit 5 in the arrow A direction using the slide rails 11. When the safe unit 5 has been pulled outside the device using the slide rails 11, a second gap Lα, serving as a work-access gap to fix the anchor bolts 7 to the device base plate 3, is formed between the device opening 2*b* and the safe unit rear edge 5*b*. In particular, a left side gap 51 is formed on the device left side of the second gap Lα and a right side gap 52 is formed on the device right side of the second gap Lα.

Next, the worker performs an operation to fix the respective anchor bolts 7 that have been passed through the anchor bolt holes 9*a*, 9*b*, 9*c*, and 9*d*. First, the worker inserts his arm through the left side gap 51 of the second gap Lα serving as a work-access gap, and fixes the respective anchor bolts 7 that have been passed through the anchor bolt holes 9*a* and 9*c* using nuts 8*a* and washers 8*b*.

Figure 14:
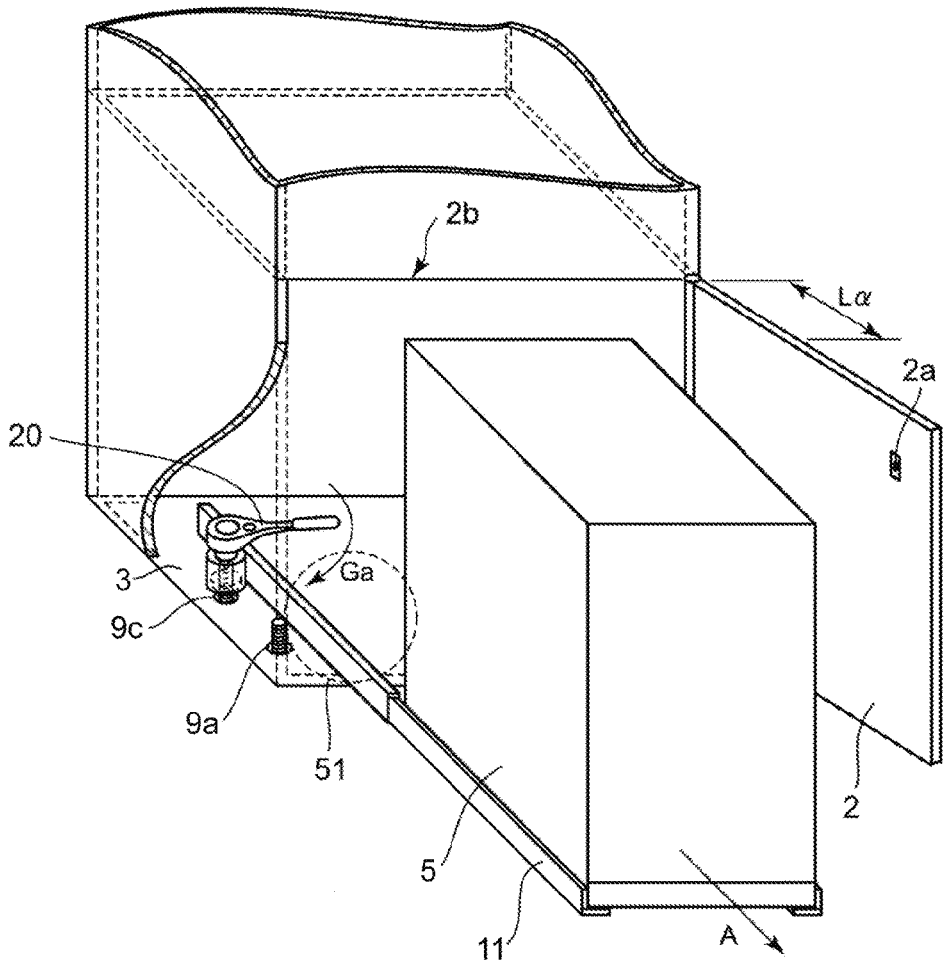
FIG. 14 is a partially cut-away perspective view illustrating a device fixing operation using anchor bolts for an automatic transaction device according to the fourth exemplary embodiment.

FIG. 14 is a partially cut-away perspective view illustrating the device fixing operation using the anchor bolts in the automatic transaction device according to the fourth exemplary embodiment. Note that FIG. 14 in a case in which the anchor bolt 7 that has been passed through the anchor bolt hole 9*c* at the approximate center in the device depth direction is being fixed; however, the same applies in a case in which the anchor bolt 7 that has been passed through the anchor bolt hole 9*a* disposed in the vicinity of the device opening 2*b* is being fixed.

As illustrated in FIG. 14, since the control board 10*a* and the wiring member 10*b* are not disposed in the left side gap 51, it is easy for the worker to insert his right arm (not illustrated in the drawings) through the left side gap 51 on the device left side. The worker inserts his right arm through the left side gap 51 and loosely fixes the nuts 8*a* and the washers 8*b*. Next, the worker tightens and fixes the nuts 8*a* using the attachment tool 20.

This tightening of the nut 8*a* is performed by push-fitting the socket 20*s* attached to the socket mount 20*a* of the attachment tool 20 over the nut 8*a*, and holding and rotating the handle 20*b* in a substantially horizontal direction. Namely, in the left side gap 51 on the device left side, the worker repeatedly performs a forward and backward action to tighten the nut 8*a* by repeated actions of rotating the attachment tool 20 approximately 90° in the arrow Ga direction from the device back side toward the device opening 2*b* to tighten the nut 8*a*, and free-rotating the attachment tool 20 back in the opposite direction to the arrow Ga.

Figure 15:
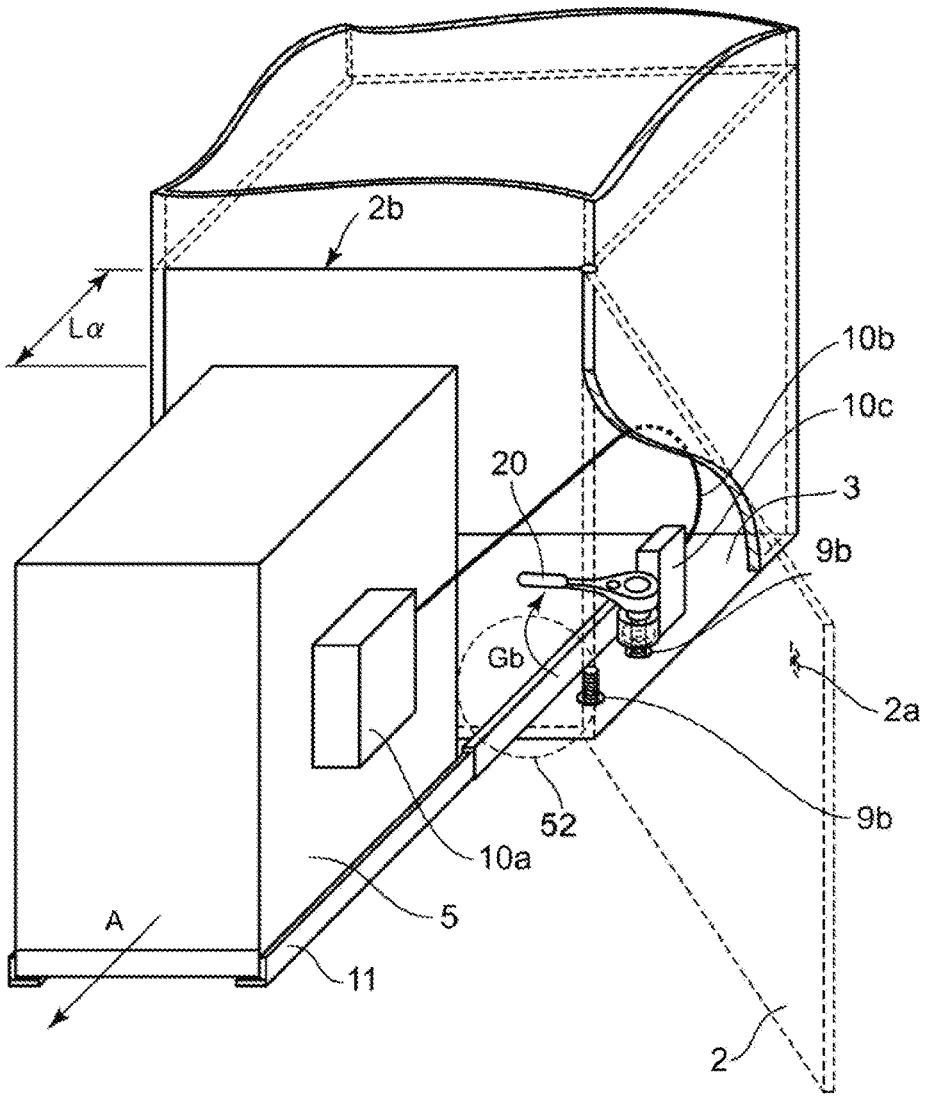
FIG. 15 is a partially cut-away perspective view illustrating a device fixing operation using anchor bolts for an automatic transaction device according to the fourth exemplary embodiment.

Next, the worker inserts his left arm (not illustrated in the drawings) through the right side gap 52 on the device right side, as illustrated in FIG. 15, and fixes the respective anchor bolts 7 that have been passed through the anchor bolt holes 9*b* and 9*d* using the nuts 8*a* and the washers 8*b*.

FIG. 15 is a partially cut-away perspective view illustrating the device fixing operation using the anchor bolts in the automatic transaction device according to the fourth exemplary embodiment. Note that FIG. 15 illustrates a case in which the anchor bolt 7 that has been passed through the anchor bolt hole 9*d* at the approximate center in the device depth direction is being fixed; however, the same applies in a case in which the anchor bolt 7 that has been passed through the anchor bolt hole 9*b* in the vicinity of the device opening 2*b* is being fixed.

As illustrated in FIG. 15, the control board 10*a* is provided on the right side face of the safe unit 5, slightly toward the device opening 2*b* from the approximate center in the device depth direction. Accordingly, when the safe unit 5 is slid, the control board 10*a* leaves the right side gap 52, such that it is easy for the worker to insert his left arm at the device right side. The worker is able to fix the respective anchor bolts 7 that have been passed through the anchor bolt hole 9*b* and 9*d* with his left arm, while avoiding the control board 10*a* and the wiring member 10*b*. At the device right side, the nut 8*a* is tightened by repeatedly performing a forward and backward action of rotating the attachment tool 20 approximately 90° in the arrow Gb direction from the device opening 2*b* side toward the device back side to tighten the nut 8, and free-rotating the attachment tool 20 back in the opposite direction to the arrow Gb.

When the device fixing operation using the anchor bolts 7 is finished, the safe unit 5 is slid using the slide rails 11 so as to push and fix the safe unit 5 inside the device. The safe door 2 is then closed and locked with the door lock 2*a*. The device fixing operation using the anchor bolts 7 for the automatic transaction device 1 is thus completed.

Note that the foregoing explanation describes the device fixing operation using the anchor bolts 7 being performed at the anchor bolt holes 9*a* and 9*b* disposed in the vicinity of the device opening 2*b* after pulling out the safe unit 5. However, the device fixing operation at the anchor bolt holes 9*a* and 9*b* may be performed before pulling out the safe unit 5. So doing enables the automatic transaction device 1 to be prevented from falling over when the safe unit 5 is pulled out.

As described above, in the automatic transaction device 1 according to the fourth exemplary embodiment, in the respective first gaps L1 formed between the device casing 1*x* and the safe unit 5 on the left and right as viewed from the device opening 2*b*, the anchor bolt holes 9*a* and 9*b* are disposed in the vicinity of the device opening 2*b*. The anchor bolt holes 9*c* and 9*d* disposed at the approximate center in the device depth direction are disposed within approximately an arm's length range of an adult from the device opening 2*b*, such that the attachment tool can be rotated through approximately 90° in a substantially horizontal direction. As a result, in the automatic transaction device 1 according to the fourth exemplary embodiment, the device fixing operation using the anchor bolts 7 can be performed efficiently without removing the safe unit 5 and the device internal components 10 installed inside the device. As a result, in addition to the effects of the automatic transaction device 1 according to the first exemplary embodiment, the automatic transaction device 1 according to the fourth exemplary embodiment enables a device fixing operation employing an attachment tool to be performed simply and in a short space of time, and also enables at the same time enhancement of the ability to withstand load of the automatic transaction device 1.

Fifth Exemplary Embodiment

The configuration of an automatic transaction device 1 according to a fifth exemplary embodiment differs from that of the automatic transaction device 1 according to the first exemplary embodiment illustrated in FIG. 1 in the placement configuration of the anchor bolt holes. The automatic transaction device 1 according to the fifth exemplary embodiment is provided with slide rails 11 to move a safe unit 5 outside the device, similarly to in the automatic transaction device 1 according to the second exemplary embodiment. The automatic transaction device 1 according to the fifth exemplary embodiment has a structure in which, when the safe unit 5 has been pulled outside the device, a second gap Lα serving as a work-access gap is formed between a device opening 2*b* and a safe unit rear edge 5*b*. Other configuration is similar to configuration of the automatic transaction device 1 according to the first and second exemplary embodiments, and explanation regarding such similar configuration is omitted in the interests of brevity.

Figure 16:
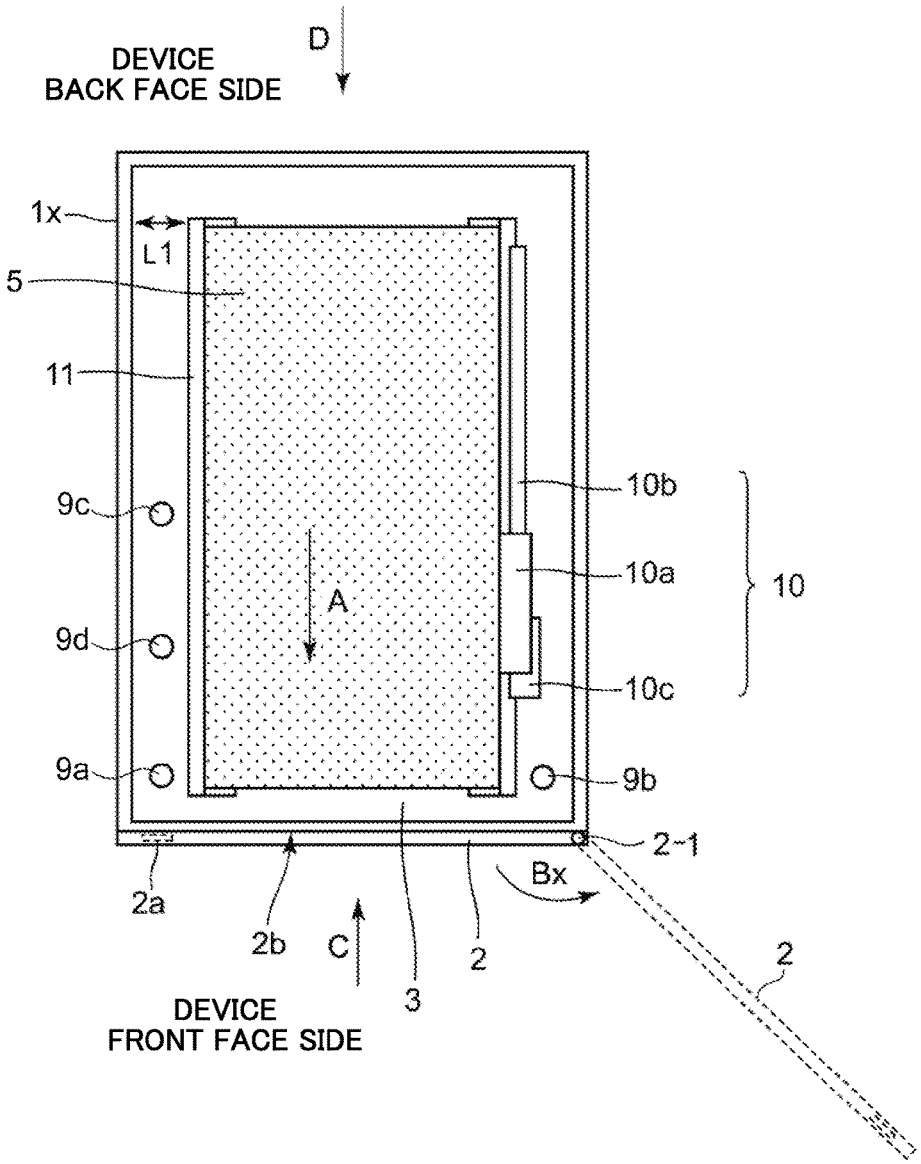
FIG. 16 is an explanatory diagram illustrating the interior of an automatic transaction device according to a fifth exemplary embodiment, as viewed from above.

First, explanation follows regarding a placement configuration of the anchor bolt holes 9 provided in the device base plate 3 of the automatic transaction device 1. FIG. 16 is an explanatory diagram of the interior of the automatic transaction device according to the fifth exemplary embodiment, as viewed from above.

In the automatic transaction device 1 according to the fifth exemplary embodiment, the anchor bolt holes 9 configuring fixing member holes are not disposed at the backmost positions as viewed from the device opening 2*b*. The anchor bolt holes 9 are disposed more toward the device opening 2*b* than the approximate center in the device depth direction. Namely, the two anchor bolt holes 9*a* and 9*b* in the vicinity of the device opening 2*b* are disposed at positions in close proximity to the device opening 2*b*, similarly to in the automatic transaction device 1 according to the first exemplary embodiment. In the automatic transaction device 1 according to the present exemplary embodiment, the two other anchor bolt holes 9*c* and 9*d* are provided in only the first gap L1 between the device casing 1*x* and the safe unit 5 on the left side, and are disposed equidistant from one another toward the device opening 2*b* from the approximate center in the device depth direction. Specifically, the anchor bolt hole 9*c* is disposed toward the device opening 2*b* from the approximate center in the device depth direction of the first gap L1, and the anchor bolt hole 9*d* is disposed at a position midway between the anchor bolt hole 9*a* and the anchor bolt hole 9*c*.

Disposing the equidistant anchor bolt holes 9*c* and 9*d* more toward the device opening 2*b* than the approximate center in the device depth direction of the first gap L1 only on the left side makes a device fixing operation using the anchor bolts 7 comparatively easy, and enables the ability to withstand load in the device front-rear direction, namely from the arrow C and the arrow D directions, to be enhanced in comparison to that of the automatic transaction device 1 according to the first exemplary embodiment. The reason for disposing the anchor bolt holes 9*c* and 9*d* in only the first gap L1 between the device casing 1*x* and the safe unit 5 on the left side is that the device internal components 10, such as the control board 10*a*, the wiring member 10*b* and the connector 10*c*, are disposed as device internal components 10 on the right side in the first gap L1 between the device casing 1*x* and the safe unit 5.

Similarly to in the second exemplary embodiment, the slide rails 11 have a structure allowing the safe unit 5 to be pulled outside the device until the second gap Lα (see FIG. 17) is formed as a work-access gap between the device opening 2*b* and the safe unit rear edge 5*b*. A left side gap 51 is formed at the device left side of the second gap Lα, and a right side gap 52 is formed at the device right side of the second gap Lα. Due to the second gap Lα being formed in this manner, the present exemplary embodiment facilitates the device fixing operation using the anchor bolts 7 at the anchor bolt holes 9*c* and 9*d* that are disposed on the device opening 2*b* side of the approximate center in the device depth direction.

The device fixing operation using the anchor bolts 7 in the automatic transaction device 1 according to the fifth exemplary embodiment configured as described above is performed in the following manner. First, a worker performs an anchor bolt fixing operation to fix the anchor bolts 7 in the ground 6. In the anchor bolt fixing operation, the placement configuration for embedding the anchor bolts 7 differs from that of the automatic transaction device 1 according to the first to fourth exemplary embodiments. Namely, as illustrated in FIG. 16, for the anchor bolt holes 9*a* and 9*b*, the anchor bolts 7 are embedded with a placement configuration so as to be in the first gaps L1 between the device casing 1*x* and the safe unit 5 and in the vicinity of the device opening 2*b*. For the anchor bolt holes 9*c* and 9*d*, the anchor bolts 7 are embedded with a placement configuration so as to be in the left side first gap L1 between the device casing 1*x* and the safe unit 5 and equidistant to one another on the device opening 2*b* side of the approximate center in the device depth direction.

The operation to fix the anchor bolts 7 in the ground 6 is similar to the operation described above with reference to FIG. 2 in the description of the automatic transaction device 1 according to the first exemplary embodiment, and so explanation thereof is omitted in the interests of brevity.

Next, the worker performs a device fixing operation to fix the automatic transaction device 1 using the anchor bolts 7. In the device fixing operation using the anchor bolts 7, the automatic transaction device 1 is first installed such that the anchor bolts 7 fixed in the ground 6 pass through the respective anchor bolt holes 9*a*, 9*b*, 9*c*, and 9*d* in the device base plate 3 of the automatic transaction device 1. The worker then unlocks the door lock 2*a* of the safe door 2 as illustrated in FIG. 16 and opens the safe door 2 in the arrow Bx direction.

Next, similarly to in the automatic transaction device 1 according to the second exemplary embodiment illustrated in FIG. 5, the worker pulls the safe unit 5 out using the slide rails 11. When this is performed, the control board 10*a* and the wiring member 10*b* are pulled out together with the safe unit 5, however, the connector 10*c* remains fixed inside the device.

Figure 17:
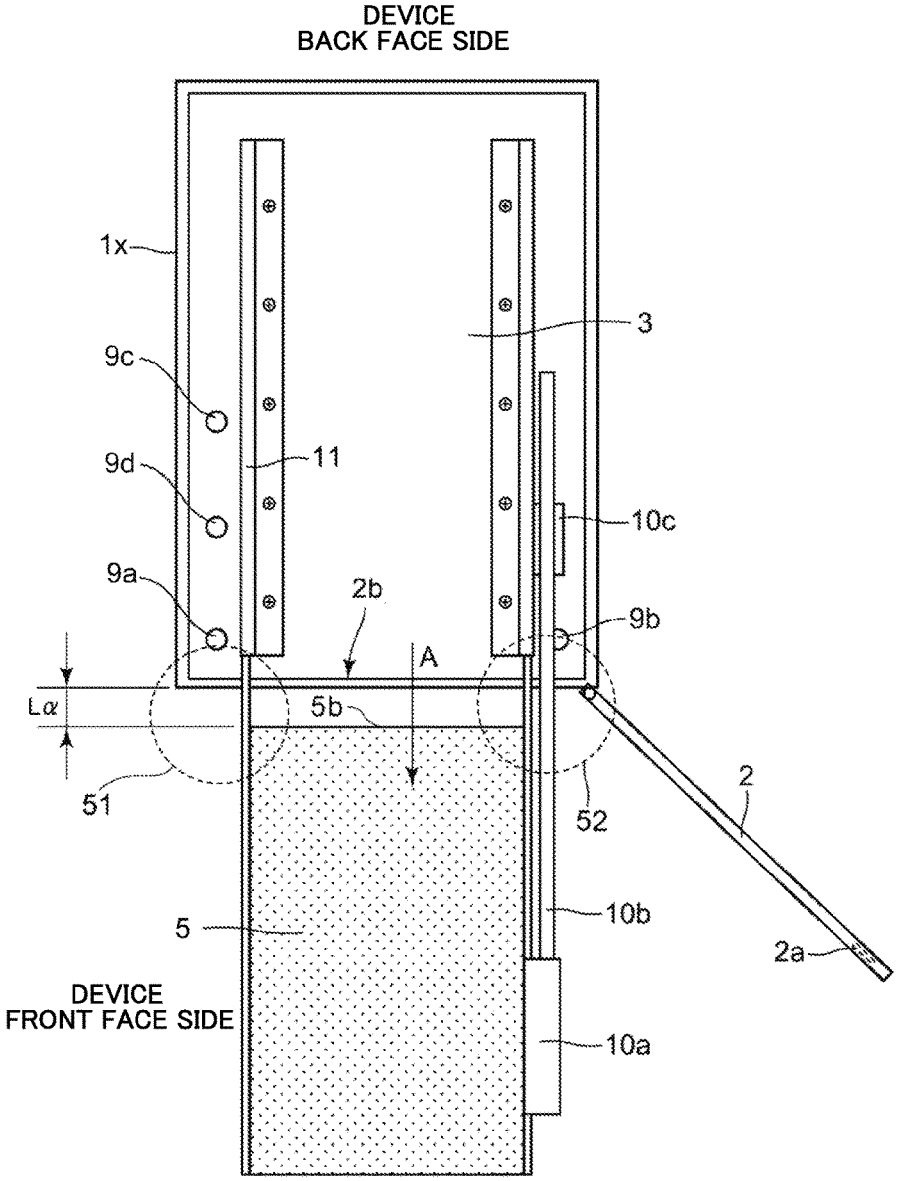
FIG. 17 is an explanatory diagram illustrating a device fixing operation using anchor bolts for an automatic transaction device according to the fifth exemplary embodiment.

Next, the worker performs the device fixing operation to fix the automatic transaction device 1 using the anchor bolts 7. FIG. 17 is an explanatory diagram illustrating the device fixing operation using the anchor bolts 7 for the automatic transaction device according to the fifth exemplary embodiment. As illustrated in FIG. 17, when the safe unit 5 has been pulled out in the arrow A direction, the second gap Lα including the left side gap 51 and the right side gap 52 is formed between the device opening 2*b* and the safe unit rear edge 5*b*.

Figure 18:
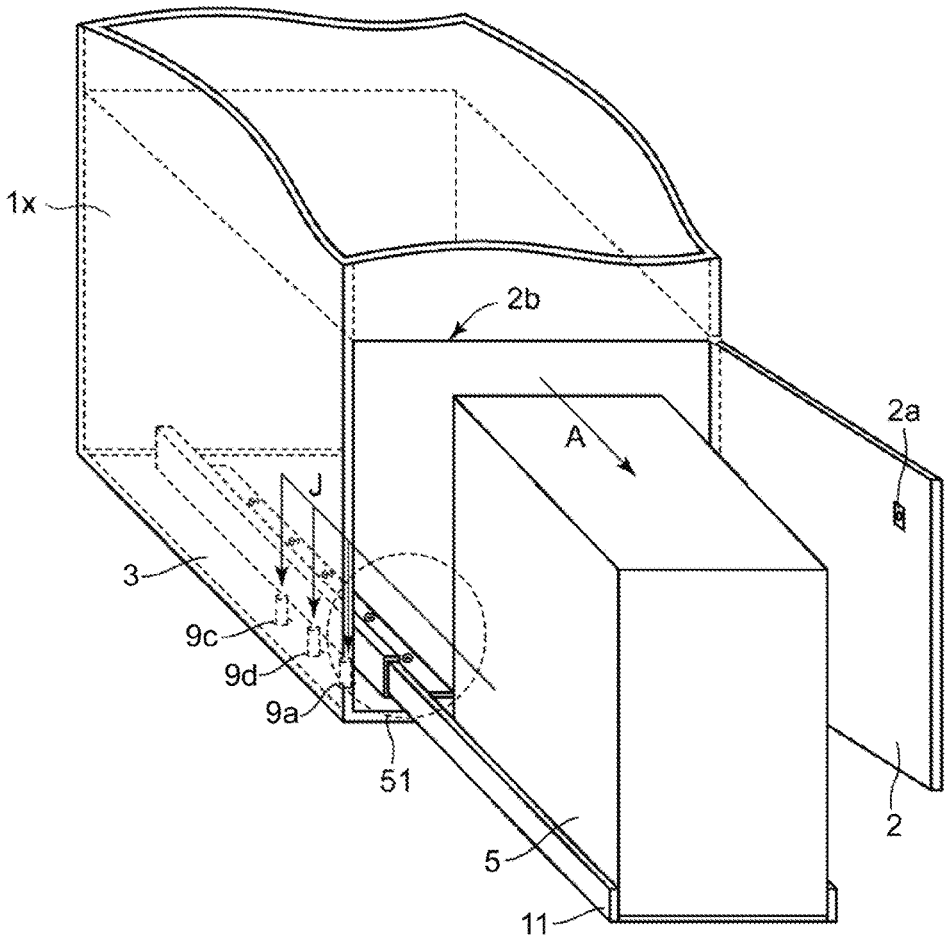
FIG. 18 is a perspective view illustrating a device fixing operation using anchor bolts for an automatic transaction device according to the fifth exemplary embodiment.

The worker then inserts his right arm through the left side gap 51 on the device left side of the second gap Lα, and fixes the respective anchor bolts 7 that have been passed through the anchor bolt holes 9*a*, 9*c*, and 9*d* using nuts 8*a* and washers 8*b*. FIG. 18 is a perspective view illustrating the device fixing operation using the anchor bolts 7 in the automatic transaction device according to the fifth exemplary embodiment.

As illustrated in FIG. 18, if the worker is right-handed, then it is easy to insert his right arm through the left side gap 51 on the device left side. The control board 10*a* and the wiring member 10*b* are not present in the left side gap 51, and so the worker can easily fix the respective anchor bolts 7 that have been passed through the anchor bolt holes 9*a*, 9*c*, and 9*d* using the nuts 8*a* and the washers 8*b* by extending his right arm in the arrow J directions.

Figure 19:
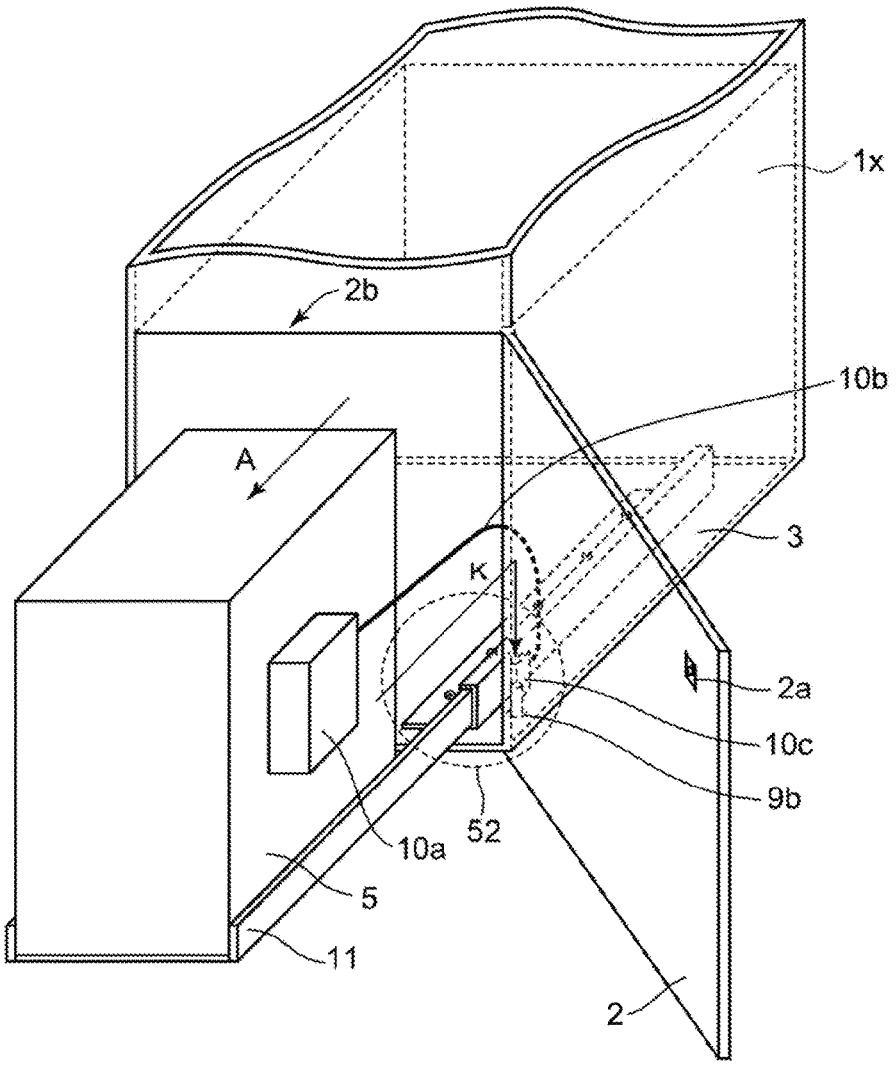
FIG. 19 is a perspective view illustrating action of a device fixing operation using anchor bolts for an automatic transaction device according to the fifth exemplary embodiment.

Next, the worker fixes the anchor bolt 7 that has been passed through the anchor bolt hole 9*d* using a nut 8*a* and a washer 8*b* through the right side gap 51 on the device right side of the second gap Lα. FIG. 19 is a perspective view illustrating the device fixing operation for the automatic transaction device according to the fifth exemplary embodiment.

As illustrated in FIG. 19, the worker can easily insert his left arm at the device right side, and can easily fix the anchor bolt 7 that has been passed through the anchor bolt hole 9*b* using the nut 8*a* and the washer 8*b* by extending his arm in the arrow K direction, while avoiding the control board 10*a* and the wiring member 10*b*.

In this manner, in the automatic transaction device 1 according to the fifth exemplary embodiment, more of the anchor bolt holes 9 are provided on the device left side where it is easier for a worker to insert his dominant arm when he is right-handed, and fewer of the anchor bolt holes 9 are provided on the device right side where it is easier to insert his non-dominant left arm. This thereby enables operations on the side using the non-dominant arm to be reduced, enabling operational efficiency to be improved.

Moreover, operation on the device right side, where the device internal components 10 of the control board 10*a*, the wiring member 10*b*, and the connector are present, needs to avoid these components. In the automatic transaction device 1 according to the fifth exemplary embodiment, the device fixing operation using the anchor bolts 7 can be reduced on the device right side where operation is more difficult, thereby enabling operational efficiency to be improved.

When the device fixing operation using the anchor bolts 7 is finished, the safe unit 5 is slid using the slide rails 11, so as to push and fix the safe unit 5 inside the device. The safe door 2 is then closed and locked with the door lock 2*a*. The device fixing operation of the automatic transaction device 1 using the anchor bolts 7 is thus completed.

Note that in the foregoing explanation, the device fixing operation using the anchor bolts 7 is performed for the anchor bolt holes 9*a* and 9*b* disposed in the device base plate 3 in the vicinity of the device opening 2*b* after the safe unit 5 has been pulled out. However, similarly to in the automatic transaction device 1 according to the second exemplary embodiment, this operation may be performed before pulling out the safe unit 5.

By fixing the anchor bolts 7 for the anchor bolt holes 9*a* and 9*b* prior to pulling out the safe unit 5, the automatic transaction device 1 can be prevented from falling over when pulling out the safe unit 5.

As described above, in the automatic transaction device 1 according to the fifth exemplary embodiment, more of the anchor bolt holes 9 are disposed in the device base plate 3 in the vicinity of the device opening 2*b* on the left side of the first gaps L1 formed on the left and right between the device casing 1*x* and the safe unit 5 as viewed from the device opening 2*b*. As a result, in addition to the effects of the automatic transaction device 1 according to the second exemplary embodiment, in the automatic transaction device 1 according to the fifth exemplary embodiment, operations using the dominant arm are facilitated when the worker is right-handed, enabling operational efficiency to be improved. At the same time, the automatic transaction device 1 according to the fifth exemplary embodiment also reduces the amount of the device fixing operation using the anchor bolts 7 that is performed on the side where the device internal components 10 are present and operation is more difficult. This also enables operational efficiency to be improved.

Modified Example 1 of the Exemplary Embodiments

In the explanation regarding the automatic transaction device 1 according to the above exemplary embodiments, examples have been described in which the safe door 2 is provided at the device front face side, and the device fixing operation using the anchor bolts 7 is performed from the device front face side. However, application may be made to cases in which the safe door 2 is provided at a device back face side.

Figure 20:
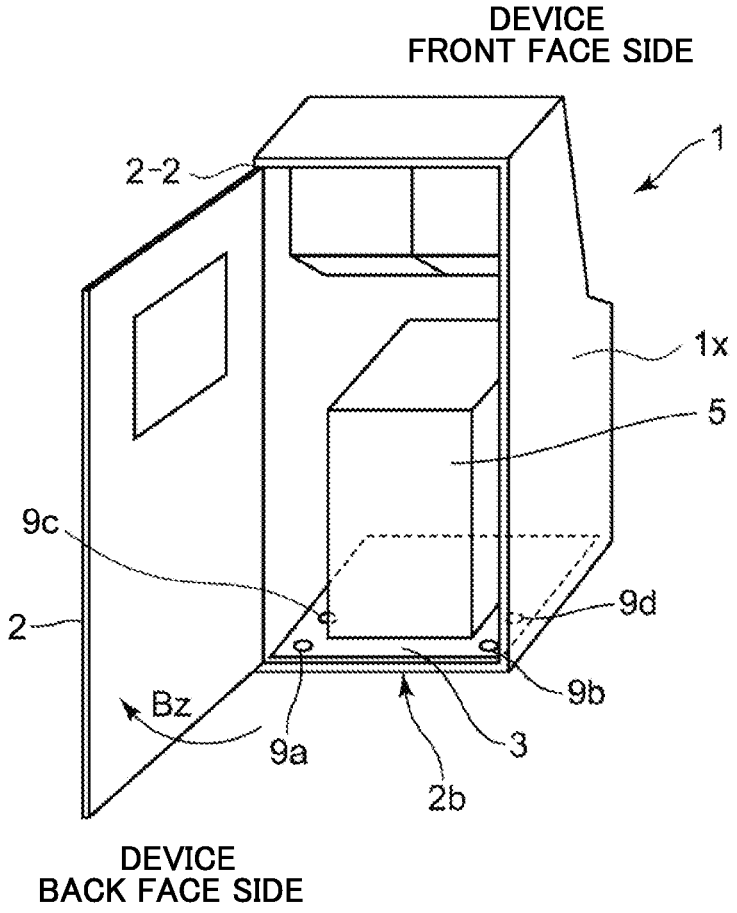
FIG. 20 is a perspective view illustrating an automatic transaction device according to a Modified Example 1 of the first exemplary embodiment.

FIG. 20 is a perspective view illustrating an automatic transaction device according to a Modified Example 1 of the first exemplary embodiment. A safe door 2 of the automatic transaction device 1 according to Modified Example 1 of the first exemplary embodiment can be opened and closed in the arrow Bz direction about a door hinge 2-2 on the left side, as viewed from the device back face side of the automatic transaction device 1. A device opening 2*b* is formed by the safe door 2 opening in the arrow Bz direction. Moreover, similarly to the automatic transaction device 1 according to the first exemplary embodiment, the automatic transaction device 1 according to Modified Example 1 includes anchor bolt holes 9*a*, 9*b*, 9*c*, and 9*d* in a device base plate 3 in the vicinity of the device opening 2*b*. By disposing the anchor bolt holes 9*a*, 9*b*, 9*c*, and 9*d* in this manner, the automatic transaction device 1 according to Modified Example 1 enables a device fixing operation using the anchor bolts 7 that employ the anchor bolt holes 9*a*, 9*b*, 9*c*, and 9*d* to be performed simply by opening the safe door 2 in the arrow Bz direction.

Moreover, similarly to the automatic transaction device 1 according to the second, fourth, and fifth exemplary embodiments, the automatic transaction device 1 according to Modified Example 1 enables the device fixing operation using the anchor bolts 7 to be performed simply by pulling out the safe unit 5 in the arrow A direction, even in cases in which the anchor bolt holes 9*a*, 9*b*, 9*c*, and 9*d* are disposed as illustrated in FIG. 4, FIG. 13, and FIG. 16.

Modified Example 2 of the Exemplary Embodiments

Moreover, in the explanation regarding the automatic transaction device 1 according to the above exemplary embodiments of the present disclosure, examples have been described in which the anchor bolt holes 9*a*, 9*b*, 9*c*, and 9*d* are disposed at different positions, as illustrated in FIG. 3, FIG. 4, or FIG. 16. However, plural anchor bolt holes 9 may be pre-formed, and positions of the anchor bolt hole 9 may be selected to match the circumstances.

Figure 21:
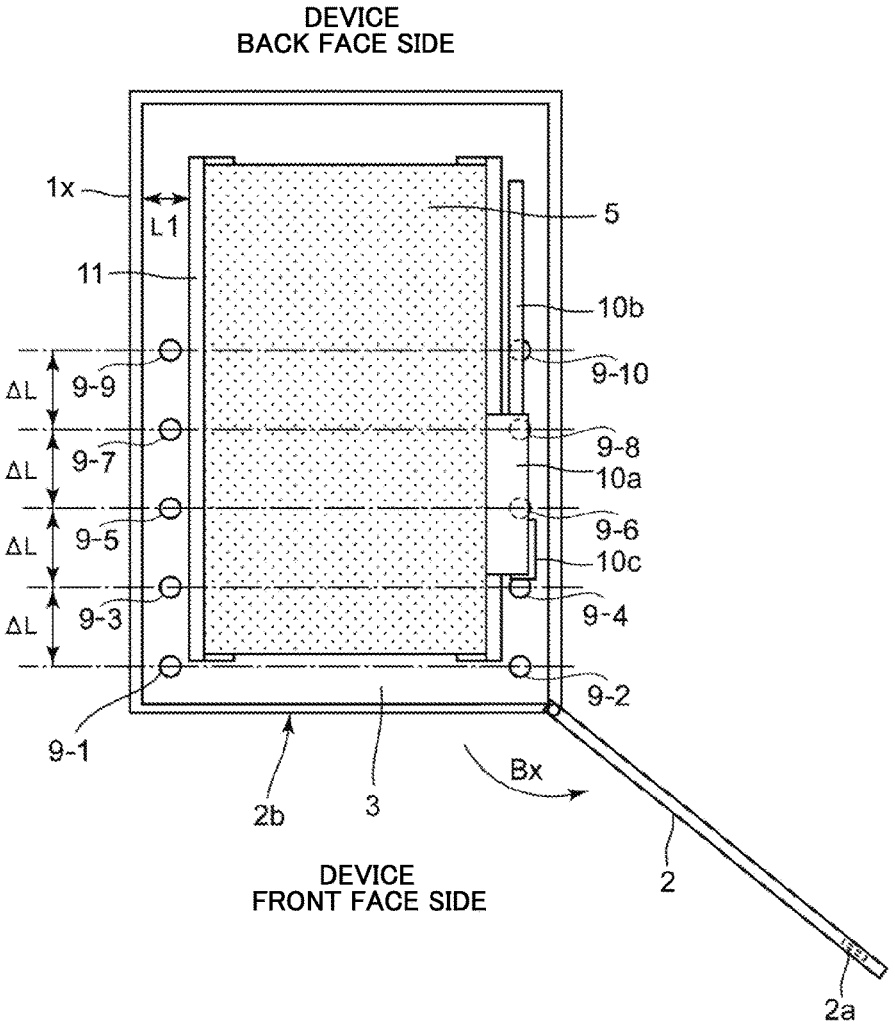
FIG. 21 is an explanatory diagram illustrating a placement configuration of anchor bolt holes in an automatic transaction device according to a Modified Example 2 of an exemplary embodiment.

FIG. 21 is an explanatory diagram illustrating a placement configuration of anchor bolt holes in an automatic transaction device according to a Modified Example 2 of the exemplary embodiments. A device base plate 3 of the automatic transaction device 1 according to Modified Example 2 of the exemplary embodiments is configured with plural anchor bolt holes 9 respectively disposed on the left and right at a predetermined spacing ΔL in the first gaps L1 between a device casing 1*x* and a safe unit 5. Namely, plural of the anchor bolt holes 9 are disposed in advance so that the anchor bolt holes 9 match different placement configurations.

Specifically, in the first gap L1 between the device casing 1*x* and the safe unit 5 on the device left side, a configuration is adopted in which an anchor bolt hole 9-1 is disposed in the vicinity of the device opening 2*b*, and moreover an anchor bolt hole 9-3 is disposed separated toward the device back side by the predetermined spacing ΔL, followed in succession by disposing anchor bolt holes 9-5, 9-7, 9-9. Furthermore, in the first gap L1 between the device casing 1*x* and the safe unit 5 on the device right side, an anchor bolt hole 9-2 is disposed in the vicinity of the device opening 2*b*, and an anchor bolt hole 9-4 is disposed separated toward the device back side by the predetermined spacing ΔL, followed in succession by disposing anchor bolt holes 9-6, 9-8, 9-10.

In this manner, by forming the plural anchor bolt holes 9 in advance at the predetermined spacing ΔL, a device fixing operation using the anchor bolts 7 can be performed in a similar manner even when placement configurations of the embedded anchor bolts 7 differs for each automatic transaction device 1 due to the wishes of the customer or the condition of the ground 6 at the installation location.

Modified Example 3 of the Exemplary Embodiments

Moreover, the explanation regarding the automatic transaction device 1 according to the second exemplary embodiment described above illustrates an example in which the anchor bolt holes 9*c* and 9*d* at the approximate center in the device depth direction are disposed so as to be at the approximate center in the device depth direction and within an arm's length range. However, the anchor bolt holes 9*c* and 9*d* may be disposed further toward the back side.

Figure 22:
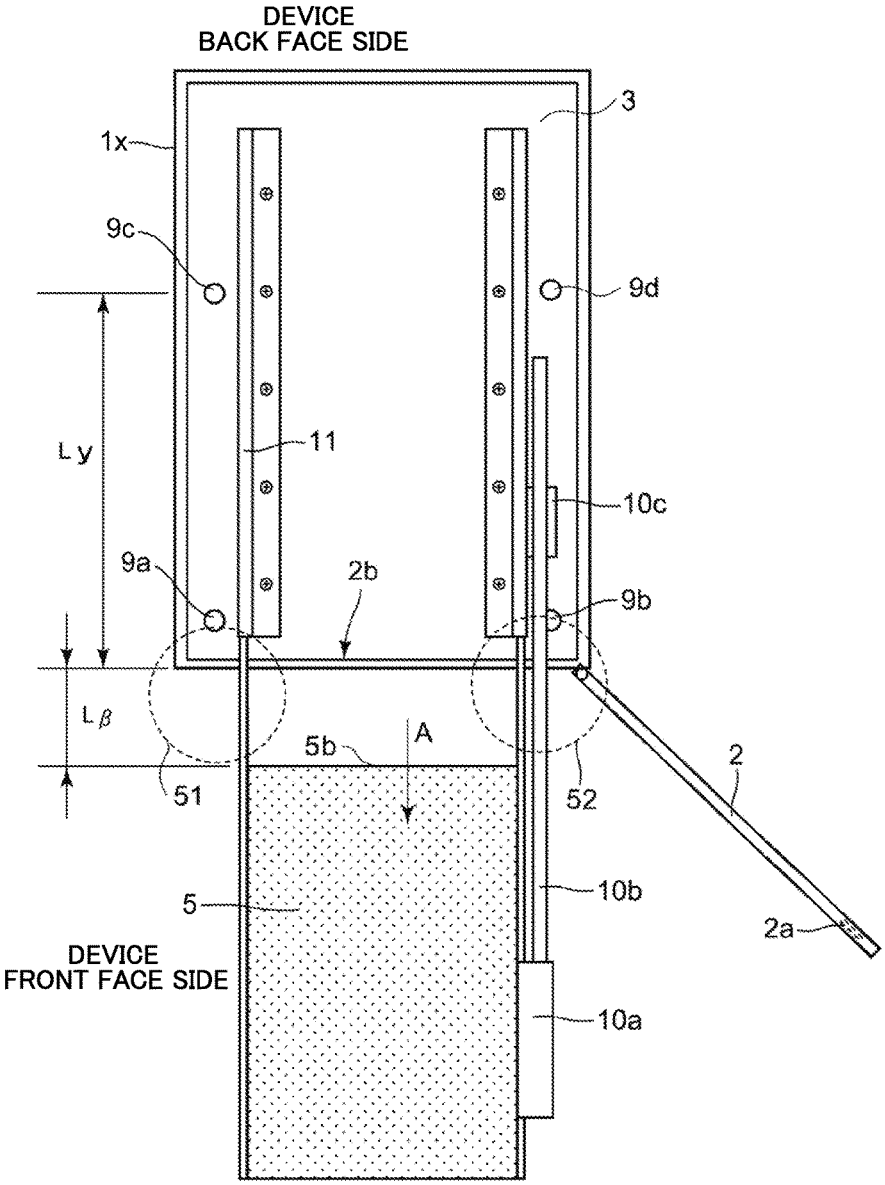
FIG. 22 is an explanatory diagram illustrating a device fixing operation using anchor bolts for an automatic transaction device according to a Modified Example 3 of the second exemplary embodiment.
Figure 23:
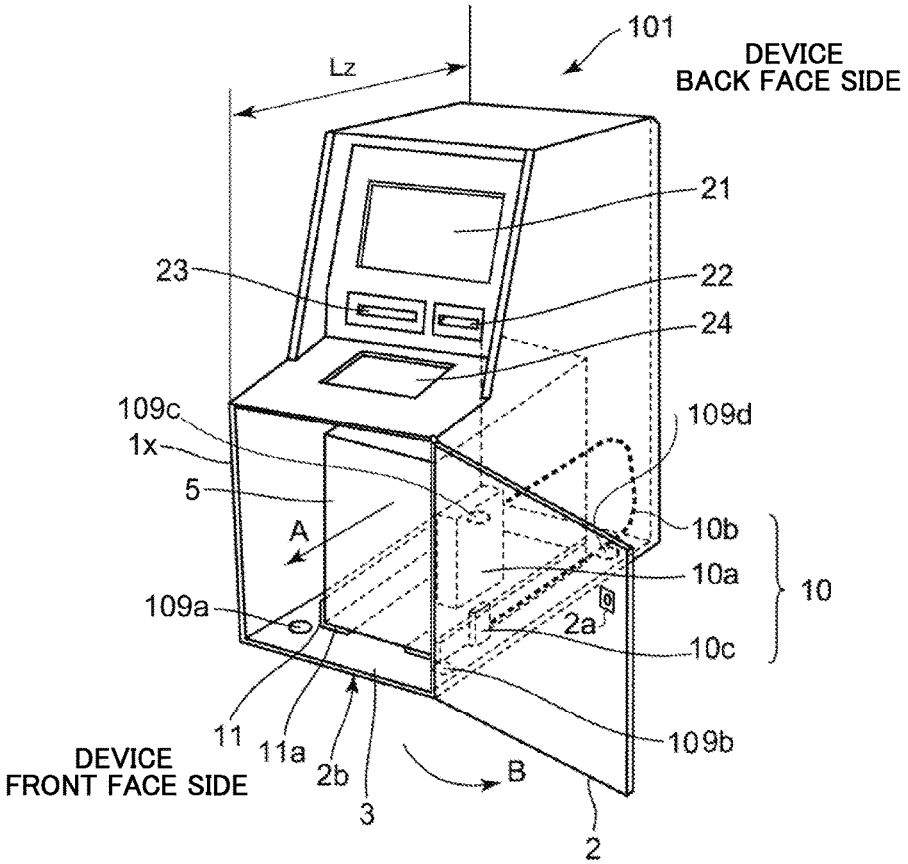
FIG. 23 is a perspective view illustrating a configuration of a conventional automatic transaction device.
Figure 24:
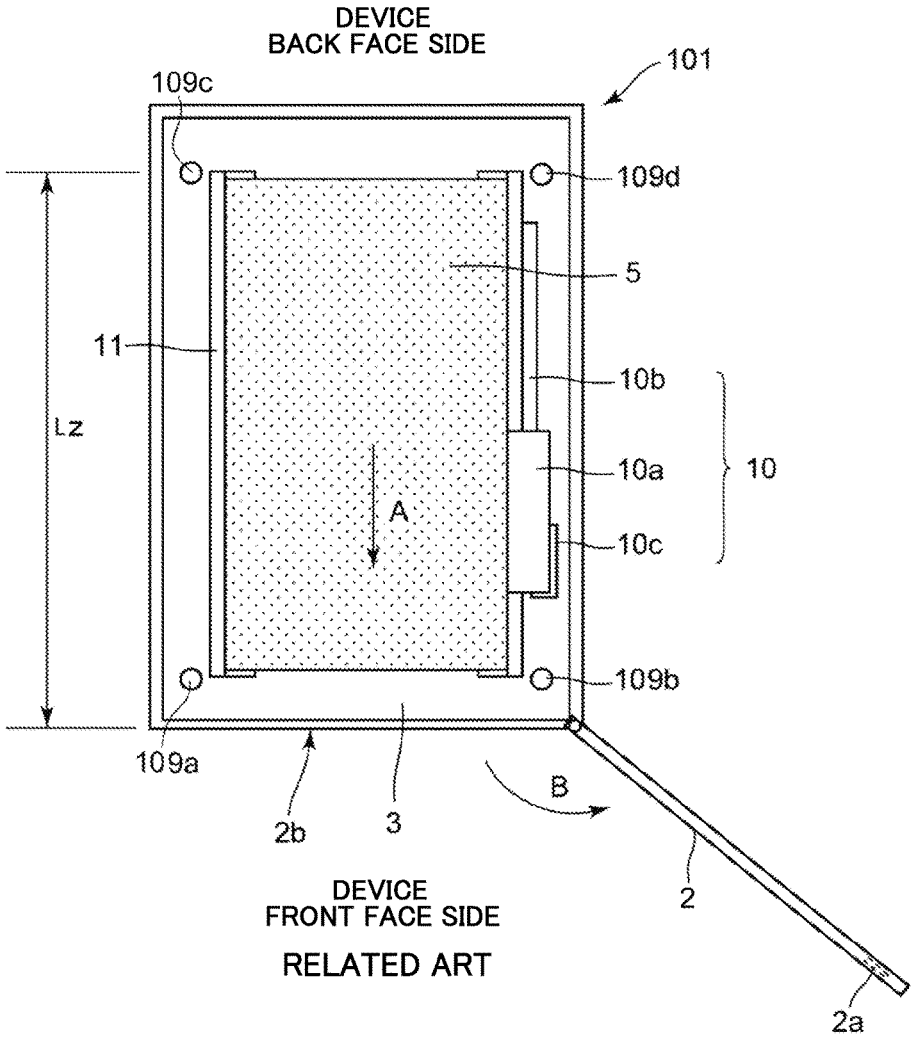
FIG. 24 is an explanatory diagram illustrating the interior of a conventional automatic transaction device, as viewed from above.

FIG. 22 is an explanatory diagram illustrating a device fixing operation using anchor bolt holes of an automatic transaction device according to a Modified Example 3 of the exemplary embodiments. As illustrated in FIG. 22, a safe unit 5 is pulled out using slide rails 11 until a work-access gap Lβ, which is wider than the work-access second gap Lα described above in the second exemplary embodiment (Lβ>Lα), is formed between a device opening 2*b* and a safe unit rear edge 5*b*. This enables a gap a portion and a gap b portion to be formed that are large enough for a worker to enter as far as his shoulders.

As a result, this enables the anchor bolt holes 9*c* and 9*d* to be disposed at positions at a length Ly (Ly>Lx) that is further toward the back side than the approximate center in the device depth direction. Disposing the anchor bolt holes 9*c* and 9*d* at the device back side in this manner enables the ability to withstand load in the device front-rear and left-right directions to be enhanced.

The range of this length Lx may be enlarged as far as an arm range of a worker holding a spanner or the like, namely the length of an arm including the shoulder. In tests, the average length Lx at which an adult male is capable of performing a device fixing operation using the anchor bolts 7 was approximately 50 cm. The placement range of the anchor bolt holes 9*c* and 9*d* may accordingly be enlarged up to this length.

Moreover, in the explanation regarding the automatic transaction device 1 according to the above exemplary embodiments, a total of four anchor bolt holes 9, the anchor bolt holes 9*a*, 9*b*, 9*c*, and 9*d*, are provided in the device base plate 3 in the vicinity of the device opening 2*b*. However, five or more anchor bolt holes 9 may be provided.

For example, three may be disposed on the device left side and two disposed on the device right side to give a total of five, or two may be disposed on the device left side and three disposed on the device right side to give a total of five, or three may be disposed on the device left side and three disposed on the device right side to give a total of six.

In the explanation regarding the automatic transaction device 1 according to the above exemplary embodiments, examples have been described in which the present disclosure is applied to an automatic transaction device such as an automatic teller machine. However, the present disclosure is widely applicable to devices where the theft of each device is to be prevented, such as automatic ticket vending machines.

The disclosure of Japanese Patent Application No. 2015-232538, and the disclosure of Japanese Patent Application No. 2016-216813 are incorporated in their entirety in the present specification by reference herein.

All cited documents, patent applications, and technical standards mentioned in the present specification are incorporated by reference in the present specification to the same extent as if the individual cited document, patent application, or technical standard was specifically and individually indicated to be incorporated by reference.

The invention claimed is:

1. An automatic transaction device comprising:

a casing that defines a first side face, a second side face, a back face, and an upper face of the device and accommodates an internal unit, a first gap being formed between the internal unit and the first side face, and a second gap being formed between the internal unit and the second side face;

a door that opens and closes an opening formed at a front face of the device; and a base plate that is formed at a base of the device, and having a plurality of through holes for fixing the device to a floor, the plurality of through holes being respectively located in the first gap and the second gap, wherein at least two of the through holes are located in the first gap, and at least two of the through holes are located in the second gap, and wherein all of the through holes are disposed only at a side of the opening and closer to the front face rather than the back face.

2. The automatic transaction device of claim 1, further comprising a moving mechanism that moves the internal unit to outside of the device through the opening, wherein an additional gap for work-access to fix a fixing member to the base plate is formed between the opening and a rear edge of the internal unit, after the internal unit has been moved outside the device.

3. The automatic transaction device of claim 2, wherein the through holes are also separated from a component installed in the first gap, by more than a rotation radius of an attachment tool for an attachment operation in the opening side.

4. The automatic transaction device of claim 3, wherein the through holes are also disposed to prevent interference between the attachment tool and a component, in a case in which the attachment tool would be rotated by a predetermined angle.

5. The automatic transaction device of claim 2, wherein the device is fixed to the floor by fixing the fixing members to the base plate at the through holes, by accessing through the additional gap.

6. The automatic transaction device of claim 2, wherein the moving mechanism is slide rails.

7. The automatic transaction device of claim 1, wherein the through holes are a plurality of through holes disposed in advance to match different placement configurations.

8. An automatic transaction device comprising:

a casing that defines a first side face, a second side face, a back face, and an upper face of the device and accommodates an internal unit, a first gap being formed between the internal unit and the first side face, a second gap being formed between the internal unit and the second side face;

a door that opens and closes an opening formed at a front face of the device;

a base plate that is formed at a base of the device, and having a plurality of through holes for fixing the device to a floor, the plurality of the through holes being respectively located in the first gap and the second gap;

a moving mechanism that moves the internal unit to outside of the device through the opening; and a component that is part of the internal unit and is disposed at the first gap, wherein the through holes are respectively disposed, so as to be disposed proximal to the opening and at an approximate center in a depth direction of the device in at least one of the first gap and the second gap.

9. The automatic transaction device of claim 8, wherein a second an additional gap for work-access to fix a fixing member to the base plate is formed between the opening and a rear edge of the internal unit, after the internal unit has been moved outside the device.

10. The automatic transaction device of claim 9, wherein the device is fixed to the floor by accessing through the additional gap which is formed by moving the internal unit to the outside of the device using the through hole disposed at the approximate center in the depth direction of the device, and fixing the fixing member to the base plate.

11. An automatic transaction device comprising:

a casing that defines a first side face, a second side face, a front face, and an upper face of the device and accommodates an internal unit, a first gap being formed between the internal unit and the first side face, and a second gap being formed between the internal unit and the second side face;

a door that opens and closes an opening formed at a back face of the device; and a base plate that is formed at a base of the device, and having a plurality of through holes for fixing the device to a floor, the plurality of through holes being respectively located in the first gap and the second gap, wherein at least two of the through holes are located in the first gap, and at least two of the through holes are located in the second gap, and wherein all of the through holes are disposed only at a side of the opening and closer to the back face rather than the front face.

* * * * *